US010843494B2

(12) United States Patent
Akaba

(10) Patent No.: US 10,843,494 B2
(45) Date of Patent: Nov. 24, 2020

(54) STAY ROD AND INKJET RECORDING APPARATUS

(71) Applicant: Katsutoshi Akaba, Kanagawa (JP)

(72) Inventor: Katsutoshi Akaba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/448,628

(22) Filed: Jun. 21, 2019

(65) Prior Publication Data

US 2020/0001634 A1 Jan. 2, 2020

(30) Foreign Application Priority Data

Jun. 28, 2018 (JP) ..... 2018-123676

(51) Int. Cl.
*B41J 19/00* (2006.01)

(52) U.S. Cl.
CPC ..... *B41J 19/00* (2013.01)

(58) Field of Classification Search
CPC ..... B41J 19/00
See application file for complete search history.

(56) References Cited

U.S. PATENT DOCUMENTS 5,195,836 A * 3/1993 Longust ..... B41J 19/20 347/37
2013/0271527 A1 10/2013 Shimizu
2016/0121634 A1 5/2016 Saiga et al.
2016/0297212 A1 10/2016 Saiga et al.
2017/0106686 A1* 4/2017 Hiruma ..... B41J 19/00
2018/0311983 A1 11/2018 Saiga

FOREIGN PATENT DOCUMENTS

JP 2001-030477 2/2001
JP 2009-073226 4/2009
JP 2013-233792 11/2013

* cited by examiner

*Primary Examiner* — Julian D Huffman
(74) *Attorney, Agent, or Firm* — Duft & Bornsen, PC

(57) ABSTRACT

A stay rod includes a guide to slidably hold a functional part, the guide to be fixed to an apparatus body, a plurality of first parts each including a guide surface to form the guide, and a plurality of second parts each including a mounting surface to be mounted to the apparatus body. The plurality of first parts and the plurality of second parts are combined to have an elongated box-shaped cross section in which the guide surface of the plurality of first parts faces the mounting surface of the plurality of second parts, the plurality of first parts is arranged side by side in a longitudinal direction of the stay rod and is joined to the plurality of second pars at each joint formed at each end of the plurality of first parts.

13 Claims, 34 Drawing Sheets

STAY ROD AND INKJET RECORDING APPARATUS

CROSS-REFERENCE TO RELATED APPLICATIONS

This patent application is based on and claims priority pursuant to 35 U.S.C. § 119(a) to Japanese Patent Application No. 2018-123676, filed on Jun. 28, 2018, in the Japan Patent Office, the entire disclosure of which is hereby incorporated by reference herein.

BACKGROUND

Technical Field

The present disclosure relates to a stay rod and an inkjet recording apparatus.

Related Art

An inkjet-type image forming apparatus (inkjet recording apparatus) is an apparatus to discharge an imaging material such as liquid ink onto a recording medium. The inkjet recording apparatus includes a recording head to discharge the imaging material. Hereinafter, the "recording head" or a "liquid discharge head" is simply referred to as the "head". The head is mounted on a carriage having a structure that linearly slides in a main scanning direction orthogonal to a direction of conveyance of the recording medium. The carriage is supported by a housing of the inkjet recording apparatus via a carriage holder. The carriage holder has a structure that slidably supports the carriage while maintains linear movement of the carriage.

Particularly, an inkjet recording apparatus that records images onto a wide recording medium (a recording medium having a long dimension in the main scanning direction) has to support the carriage to slide linearly with high accuracy since the carriage travels far. Thus, the carriage holder is required to have high planar accuracy in a holding surface of the carriage to hold the carriage and high rigidity to maintain the planar accuracy of the holding surface of the carriage. If the planar accuracy of the surface of the carriage of a stay rod is poor, the head is inclined with respect to the recording medium. Further, if the rigidity of the stay rod is insufficient, the stay rod may be bent depending on a position of the carriage in the main scanning direction. As a result, the size of a gap between a nozzle face of the head and the recording medium may vary along the nozzle face of the head, which head includes nozzles on the nozzle face to discharge ink liquids from the nozzles. The irregularity in the gap may degrade the quality of the image formed by the imaging material of the liquid discharged from the head.

Therefore, the stay rod is formed to have sufficient rigidity and includes an adjustment structure to adjust accuracy of the holding surface of the carriage. Hereinafter, the "holding surface of the carriage" may be also referred to as "guide rail fixing surface".

SUMMARY

In one aspect of this disclosure, a novel stay rod includes a guide to slidably hold a functional part, the guide to be fixed to an apparatus body, a plurality of first parts each including a guide surface to form the guide, and a plurality of second parts each including a mounting surface to be mounted to the apparatus body. The plurality of first parts and the plurality of second parts are combined to have an elongated box-shaped cross section in which the guide surface of the plurality of first parts faces the mounting surface of the plurality of second parts. The plurality of first parts is arranged side by side in a longitudinal direction of the stay rod and is joined to the plurality of second parts at each joint formed at each end of the plurality of first parts, the plurality of second parts is fitted together in the longitudinal direction of the stay rod at each of a fitting part formed at each end of the plurality of second parts, and a position of the joint at each end of the plurality of first parts differs from a position of the fitting part at each end of the plurality of second parts.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
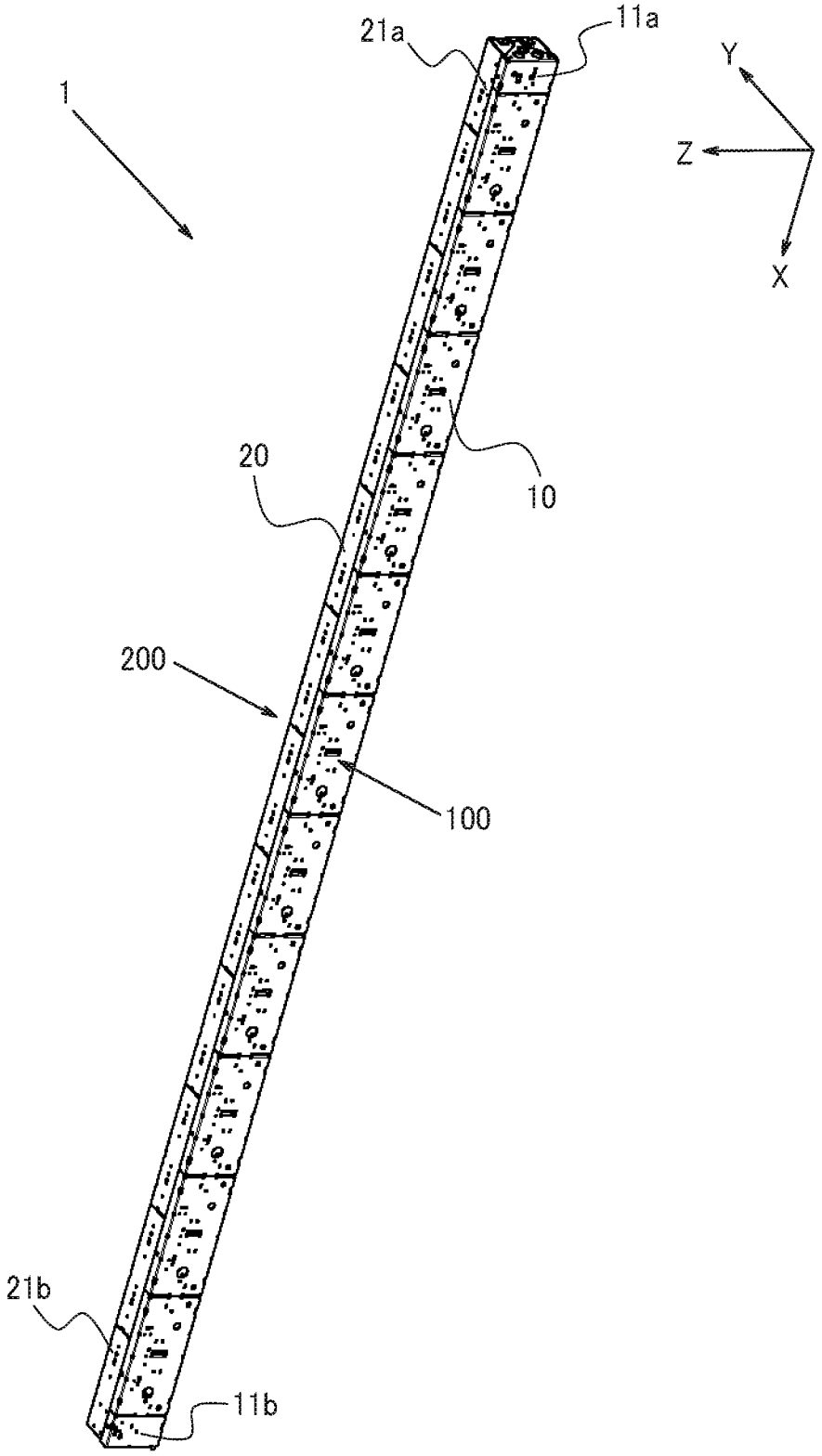
FIG. 1 is a perspective view of an entire configuration of a stay rod according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

Embodiments of the present disclosure are described below with reference to the attached drawings.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

[Embodiment of Stay Rod]

The stay rod according to the present disclosure is a member to hold a functional part that is linearly movable. The stay rod includes a combination of "a plurality of parts" each having a size shorter than a full length of the stay rod in a longitudinal direction of the stay rod. The plurality of parts is roughly divided into two types. A first type includes a first part that forms a "functional part holding surface" that becomes a guide surface to maintain a linearity of slidable movement of the functional part. A second type includes a second part that forms a "stay fixing surface" that becomes a mounting surface to fix the first part to an apparatus (for example, an inkjet recording apparatus) onto which the functional part is mounted.

The stay rod according to the present disclosure is formed by fitting a first part into a "combined structural body" formed by putting together a plurality of second parts in the longitudinal direction. The combined structural body is a member (a C-channel member) having a long length and a "C-channel" cross-section (C-channel cross section). A plurality of the first parts is arranged side by side, fitted together and fixed in place to close the opening of the C-channel member to form a box-shaped member having a square cross-section. The box-shaped part becomes a stay rod according to the present disclosure. Thus, the stay rod according to the present disclosure has a structure to slidably hold a functional part along a surface (functional-part holding surface) formed by the combination of the plurality of parts.

Further, the stay rod includes "a fitting structure" having a shape of a joint to join and fit adjacent second parts together at both ends in a longitudinal direction of the second part constituting a combined structural body. Hereinafter, the both ends in the longitudinal direction of the second part are referred to as "longitudinal ends". The fitting structure can increase the rigidity in the longitudinal direction of the stay rod.

Further, the first part is fitted and fixed to span the fitting structure of the second parts. The first part further increases the rigidity of the stay rod. Further, a rigidity of the first part is lower than a rigidity of the second part. Therefore, the functional-part holding surface of the first part is pressed against a jig having high surface flatness (planar accuracy), and a force is applied from the second part side to the first part side. Thus, the surface of the jig (a surface having high surface flatness) can be transferred to the functional-part holding surface. Fastening the first part and the second part in a transferred state can improve the accuracy of the functional-part holding surface in the stay rod.

As described above, one aspect of the stay rod according to the present disclosure is a structure configured by joining and fitting short parts. Further, another aspect of the stay rod according to the present disclosure is to improve the surface flatness of the stay rod by transferring the functional-part holding surface from another surface having high surface flatness. Thus, the stay rod according to the present disclosure is inexpensive and has high precision and high rigidity.

[Overall Structure of Stay Rod 1]

Next, a stay rod 1 which is an embodiment of a stay rod according to the present disclosure is described with reference to the drawings.

FIG. 1 is an external perspective view of the stay rod 1. As described-above, the stay rod 1 is a functional-part holding surface to hold a carriage 400 as described below. The carriage 400 is an example of a functional part. The stay rod 1 includes a carriage guide 100 and a stay attachment 200. The carriage guide 100 configures a guide to guide the carriage 400. The stay attachment 200 functions as a stay fixing surface to fix the stay rod 1 to an apparatus using the stay rod 1. A plurality of carriage guide parts 10 as the first parts are used to form the carriage guide 100. A plurality of stay-fixing parts 20 forms the second part, and the plurality of stay-fixing parts 20 is used to form the stay attachment 200. In other words, a combination of the stay attachment 200 with the carriage guide 100 forms the stay rod 1.

In the following description, an X-axis indicates a longitudinal direction of the carriage guide 100 and the stay attachment 200. A Y-axis indicates a direction orthogonal to the X-axis and is directed from the carriage guide 100 to the stay attachment 200 as illustrated in FIG. 1. A Z-axis is orthogonal to the X-axis and the Y-axis. In the present disclosure, the X, Y, and Z axis are used to indicate the directions to describe the embodiments of the present disclosure.

The stay rod 1 includes a combinational structural body in which a plurality of the stay-fixing parts 20 is joined together to form a "C-channel (U-channel)" cross section including a flange (the stay side-surface 220) on each ends of a web (mounting surface 210). Thus, the stay-fixing part 20 has a C-channel shaped (U-channel shaped) cross section. A plurality of carriage guide parts 10 are fitted to the "C-channel member" from a +Y direction (toward a backward direction along the Y-axis in FIG. 1) to close an opening of the C-channel member facing a −Y direction (toward a front direction along the Y-axis) in FIG. 1. The C-channel member and the carriage guide part 10 are fitted to form the stay rod 1. Further, stay fixing end-parts 21 (21*a* and 21*b*) are further fitted and attached to both longitudinal ends of the C-channel member. Further, carriage guide end-parts 11 (11*a* and 11*b*) are attached to both longitudinal ends of the carriage guide 100.

The number of carriage guide parts 10 and stay-fixing parts 20 joined together is selected so as to make a total length of the stay rod 1 changeable. For example, if the number of the stay-fixing parts 20 to be joined together is 11 and the number of carriage guide parts 10 fitted to the stay-fixing parts 20 is 12, the total length of the stay rod 1 exceeds 3000 mm. Further, if the number of the stay-fixing parts 20 to be joined together is 10 and the number of carriage guide parts 10 fitted to the stay-fixing parts 20 is 11, the total length of the stay rod 1 exceeds 2700 mm. As described-above, the number of stay-fixing parts 20 as the second part is determined according to a desired total length, and the number of carriage guide parts 10 as the first part is increased by one and fitted to the stay-fixing parts 20. Thus, the carriage guide 100 having an arbitrary length can be formed.

The carriage guide part 10 and the stay-fixing part 20 that constitute the stay rod 1 are formed of the same material. Further, a plate-like member is bent to form the carriage guide part 10 and the stay-fixing part 20. A thickness (plate thickness) of the carriage guide part 10 is equal to or less than the thickness (plate thickness) of the stay-fixing part 20. Thus, the carriage guide part 10 is a part having a rigidity lower than a rigidity of the stay-fixing part 20.

[Components of the Stay Rod 1]

Figure 2:
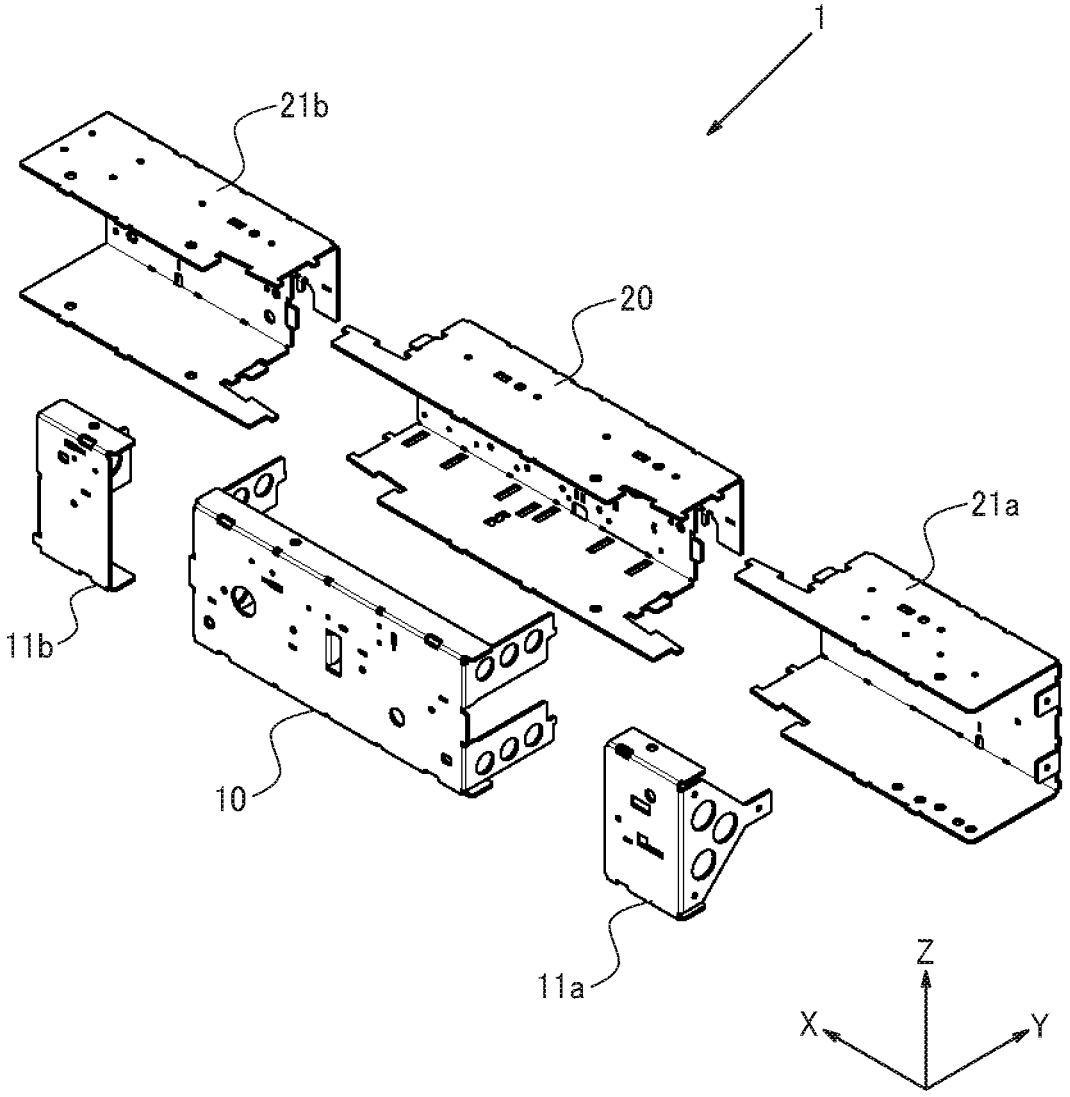
FIG. 2 is a perspective view of components of the stay rod.

Next, each part that configures the stay rod 1 is illustrated in FIG. 2. As described above, the parts that form the stay rod 1 include the carriage guide part 10 as the first part and the stay-fixing part 20 as the second part. Further, each part that forms the stay rod 1 includes carriage guide end-parts 11 (11*a* and 11*b*) disposed at both ends of the stay rod 1 and stay fixing end-parts 21 (21*a* and 21*b*).

[Configuration of the Carriage Guide Part 10]

Figure 3A:
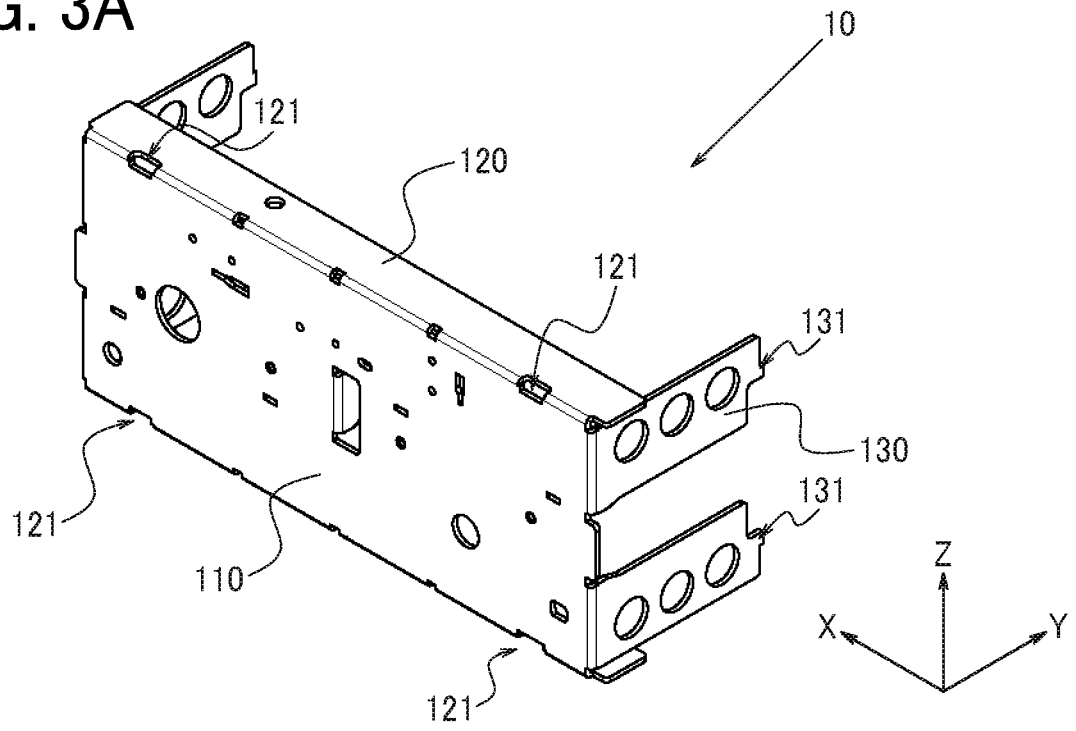
FIGS. 3A and 3B are perspective views of an embodiment of a first part as one of the components of the stay rod.
Figure 3B:
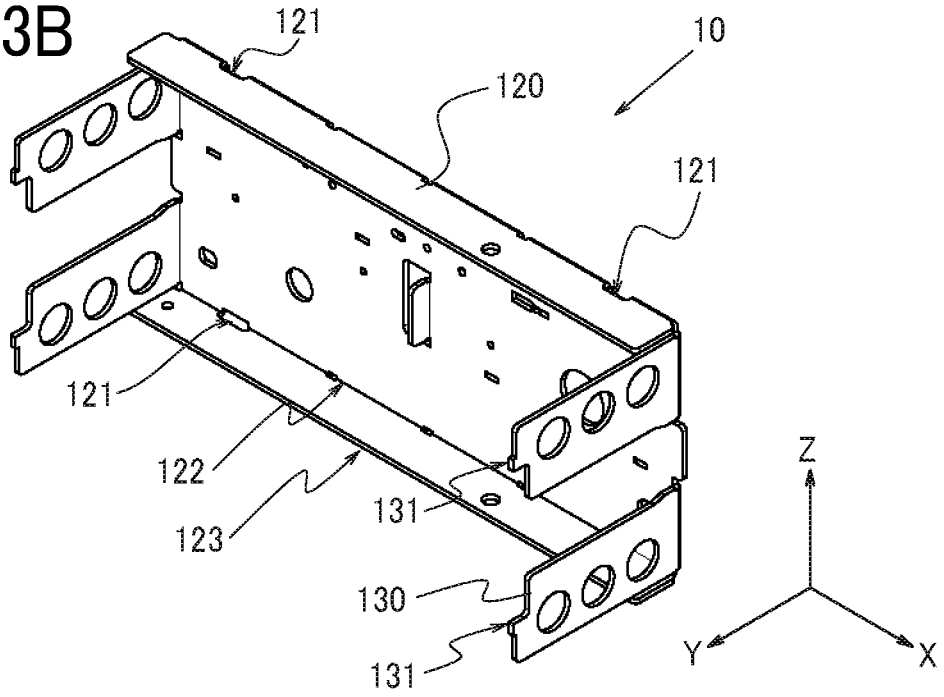

FIGS. 3A and 3B are perspective views of the carriage guide part 10. The carriage guide part 10 includes a guide surface 110 that forms the carriage guide 100 at a center of a plate-like metal (sheet metal), an overall shape of which is rectangular. Each ends of the guide surface 110 in a transverse direction (vertical direction in FIGS. 3A and 3B) of the guide surface 110 is bent in an identical Y-axis direction (+Y direction) to form a guide side-surface 120 having a predetermined height (depth). Further, the carriage guide part 10 has a plurality of legs 130 having a height (depth) greater than a height (depth) of the guide side-surface 120 by raising a part of a longitudinal end of the guide surface 110. A length of the leg 130 corresponds to a depth of the stay-fixing part 20 in the Y-axis direction.

A plurality of holes 121 is formed along a longitudinal direction (lateral direction in FIGS. 3A and 3B) of the guide surface 110 on an inner side of a bent part that becomes a boundary between the guide surface 110 and the guide side-surface 120. The inner side of the bent part is also referred to as a guide-bending inner part 122. The holes 121 are formed near both longitudinal ends of the guide-bending inner part 122 of the carriage guide part 10. The carriage guide part 10 includes a guide bending tip 123 that is a tip of a bent part that becomes a boundary between the guide surface 110 and the guide side-surface 120. Thus, the guide bending tip 123 is disposed outside a side surface of a stay-fixing part 20 when the carriage guide part 10 is fitted into the stay-fixing part 20.

Further, a convex part 131 to be fitted into a hole 213 formed in a mounting surface 210 as described below is formed at the tip of the leg 130.

[Configuration of the Stay-Fixing Part 20]

Figure 4A:
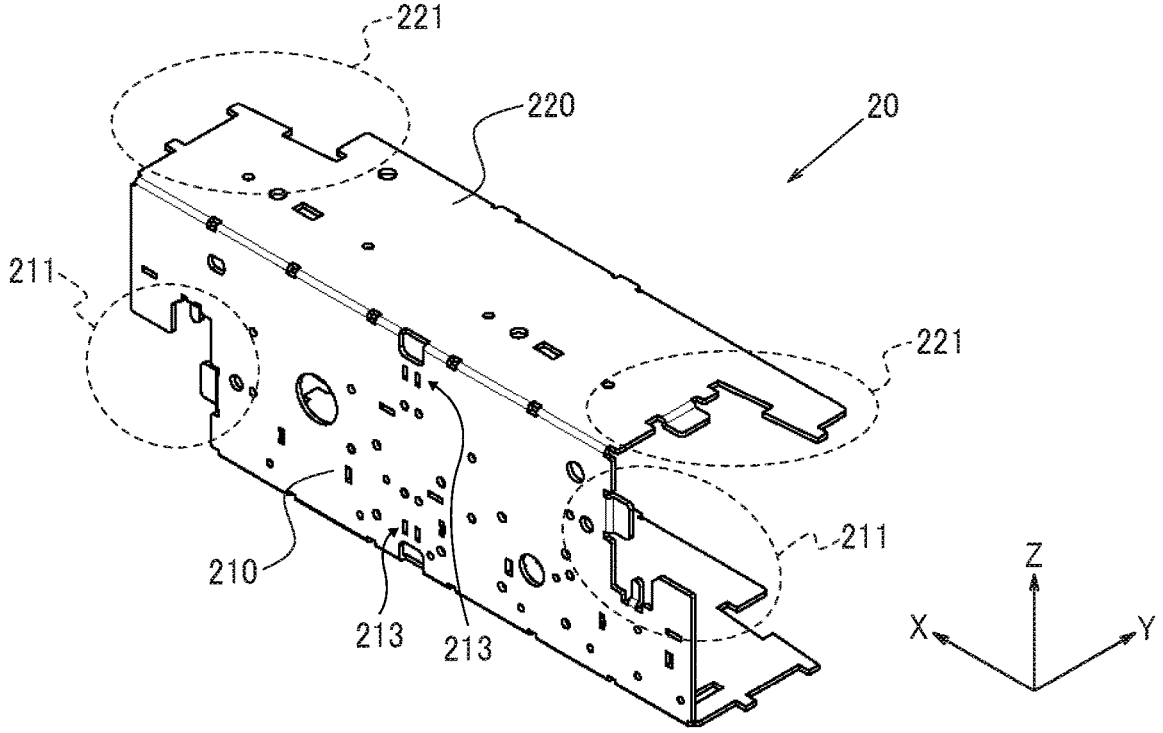
FIGS. 4A and 4B are perspective views of an embodiment of a second part as one of the components of the stay rod
Figure 4B:
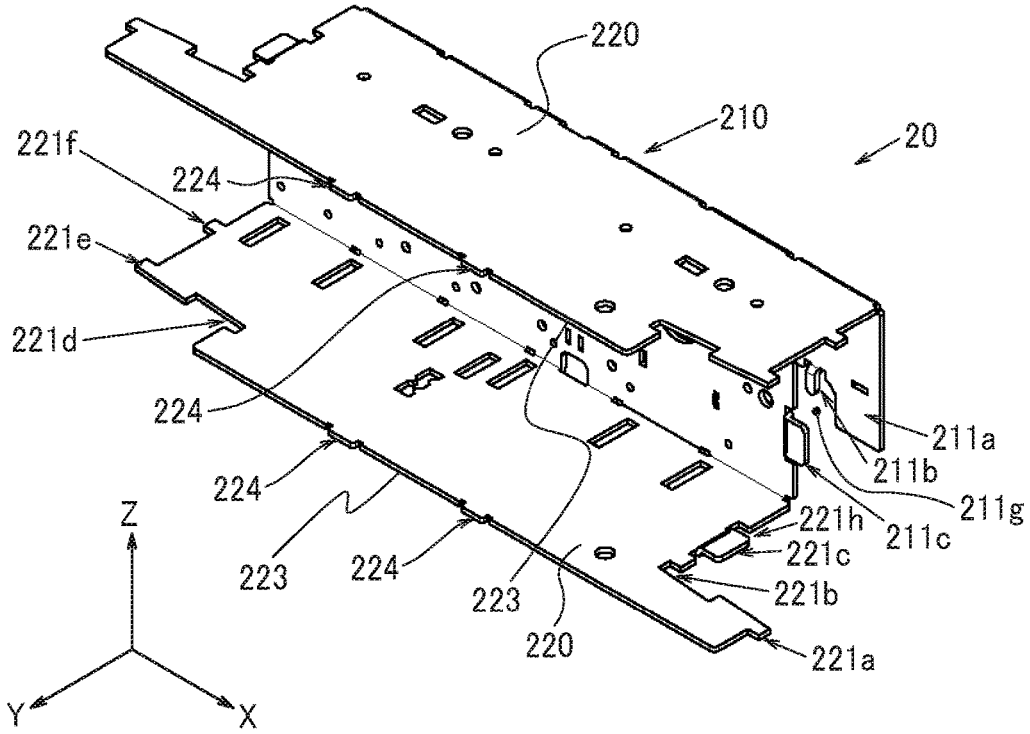

FIGS. 4A and 4B are perspective view of the stay-fixing part 20. The stay-fixing part 20 includes a mounting surface 210 that faces the guide surface 110 at a center of a plate-like metal (sheet metal), an overall shape of which is rectangular. Each end in a transverse direction (vertical direction in FIGS. 5A and 5B) of the mounting surface 210 is bent in a same Y-axis direction (−Y direction) to form a stay side-surface 220 having a predetermined height (depth). The stay-fixing part 20 includes a plurality of convex parts 224 at a tip of the stay side-surface 220 (stay bending tip 223) in a longitudinal direction of the stay-fixing part 20. The stay bending tip 223 is formed to have a dimension that fits into the hole 121 of the carriage guide part 10.

A height (depth) of the stay side-surface 220 as flanges of the stay-fixing part 20 is larger than a height (depth) of the guide side-surface 120 as flanges of the carriage guide part 10. That is, the stay-fixing part 20 is a C-channel member having a pocket deeper than a depth of a pocket of the carriage guide part 10. The carriage guide part 10 also has a C-channel (U-shaped) cross section and including flanges shorter than the flanges of the stay-fixing part 20. In other words, the carriage guide part 10 is a C-channel member having the pocket shallower than the pocket of the stay-fixing part 20. The stay side-surface 220 has a depth corresponding to a depth of the leg 130 of the carriage guide part 10. The mounting surface 210 includes a plurality of holes 213 into which the convex part 131 formed at the tip of the legs 130 are fitted.

Further, the stay-fixing part 20 includes a fitting part at both longitudinal ends of the stay-fixing part 20 as a structure to join adjacent stay-fixing parts 20 together. The fitting part includes a first fitting part 211 formed at the longitudinal ends of the mounting surface 210 and a second fitting part 221 formed at the longitudinal ends of the stay side-surface 220.

[Structure of a First Fitting Part 211]

As illustrated in FIGS. 4A and 4B, the first fitting part 211 is a key-shaped part including convex parts and concave parts. A part of an end-part in the longitudinal direction of the mounting surface 210 is notched (cut away) to form the first fitting part 211. The first fitting part 211 is formed in each end in the longitudinal direction of the mounting surface 210 of the stay fixing end-parts 21 (21*a* and 21*b*) so that the stay rod 1 is rotationally symmetrical around a center of a longitudinal direction of the stay rod 1 as a rotational center.

A longitudinal end of the mounting surface 210 is cut toward an inside in the longitudinal direction (X direction) of the mounting surface 210 for a predetermined dimension from the vicinity of a center in a transverse direction (Z direction) of the mounting surface 210 to form the first fitting part 211. Then, a part of the mounting surface 210 positioned at the longitudinal end of the mounting surface 210 is left to form a convex surface part 211*a* of the first fitting part 211 during cutting the mounting surface 210. Further, the direction of cutting is changed from the X direction to the Z direction toward the stay side-surface 220 to form the convex surface part 211*a* of the first fitting part 211. Then, the direction of cutting is further changed inward in the longitudinal direction of the mounting surface 210 (X direction) for a predetermined dimension. Then, a direction of cutting is changed toward the stay side-surface 220 opposite to the previous stay side-surface 220 so that a part of the mounting surface 210 is cut out.

The first fitting part 211 includes a convex surface part 211*a*, a first convex part 211*b*, and a second convex part 211*c*. The convex surface part 211*a* includes a surface having an end in the longitudinal direction of the stay-fixing part 20 left by the notch. The first convex part 211*b* protrudes in a "−Z direction" from the mounting surface 210 while including a portion slightly slanted in a "−Y direction" at a position spaced from the convex surface part 211*a*. The protruding direction of the first convex part 211*b* is identical to the protruding direction of the convex surface part 211*a*. Further, the second convex part 211*c* protrudes in a "X direction" while including a portion slightly slanted in the "−Y direction" from the mounting surface 210. The protruding direction of the second convex part 211*c* is perpendicular to the protruding direction of the first convex part 211*b*.

Thus, the convex surface part 211*a* of adjacent one of the stay-fixing part 20 is inserted into a recess 211*g* of another of the stay-fixing part 20 when the stay-fixing parts 20 are fitted and joined together. The first convex part 211*b* is formed in the recess 211*g* as illustrated in FIG. 4B. When the stay-fixing parts 20 are fitted and joined together, the first convex part 211*b* and the second convex part 211*c* of the another of the stay-fixing part 20 contact an inside of the convex surface part 211*a* of one of the stay-fixing part 20, and thus restricting the movement of the convex surface part 211*a* in the "−Y direction". Thus, the convex surface part 211*a*, the first convex part 211*b*, and the second convex part 211*c* facilitates positioning of the stay-fixing parts 20 when the stay-fixing parts 20 are joined and fitted to form the stay rod 1.

Further, the stay-fixing part 20 may be any shape as long as one end of one first fitting part 211 can be fitted to another end of another first fitting part 211 adjacent to the one end of the one first fitting part 211 so that the stay-fixing parts 20 can be joined together as described below. Therefore, a shape of a tip of the convex surface part 211*a* at one longitudinal end of a stay-fixing part 20 may be different from a shape of a tip of the convex surface part 211*a* at another longitudinal end of the identical stay-fixing part 20.

In the above-described embodiment, the shape of the tip of the convex surface part 211*a* formed at one longitudinal end of one stay-fixing part 20 matches the shape of the recess 211*g* formed at one longitudinal end of another stay-fixing part 20. The first convex part 211*b* is formed in the recess 211*g*. Thus, the convex surface part 211*a* formed at one longitudinal end of one stay-fixing part 20 is fitted to the recess 211*g* and the first convex part 211*b* formed at one longitudinal end of another stay-fixing part 20 arranged adjacent to the one stay-fixing part 20. Further, the shape of a first fitting part 211 at one longitudinal end of the stay-fixing part 20 may be made slightly different with the shape of another first fitting part 211 at another longitudinal end of identical stay-fixing part 20. Thus, a direction of fitting the stay-fixing parts 20 becomes clear, and it becomes easier to fit and join the stay-fixing parts 20.

[Structure of Second Fitting Part 221]

As illustrated in FIGS. 4A and 4B, the second fitting part 221 includes a joint structure formed by cutting a longitudinal end of the stay-fixing part 20 at which the first fitting part 211 is formed. As illustrated in FIG. 4A, the second fitting part 221 is formed each end of the stay side-surface 220 of the stay-fixing part 20 such that two second fitting parts 221 are rotationally symmetrical around a center of the mounting surface 210 when the stay-fixing part 20 is rotated around a center of the mounting surface 210 in the longitudinal and transverse direction of the mounting surface 210. The second fitting part 221 has a convex shape at one end of a stay side-surface 220 and has a concave shape at another end of the identical stay side-surface 220. The convex shape of the stay side-surface 220 of one stay-fixing part 20 and the concave shape of the stay side-surface 220 of another stay-fixing part 20 adjacent to the one stay-fixing part 20 are fitted and joined together to form the joint structure.

The second fitting part 221 in one longitudinal direction of the stay side-surface 220 includes a first side-convex part 221*a* formed by cutting out a part of an end of the stay bending tip 223 by a predetermined dimension. Further, the second fitting part 221 is cut out by a predetermined dimension from a longitudinal end of the stay side-surface 220 toward inside in the longitudinal direction (−X direction) to leave the first side-convex part 221*a*. The second fitting part 221 is further cut out in a direction of the stay bending tip 223 and further cut out inward in the longitudinal direction of the stay side-surface 220 to form a first side-recessed part 221*b* having a certain dimension in the longitudinal direction of the stay side-surface 220. Further, the stay side-surface 220 is cut out from a position of the first side-recessed part 221*b* to a rising part of the mounting surface 210 to form the second fitting part 221. A second side-convex part 221*c* is formed by cutting out the longitudinal end of the stay side-surface 220 up to the above-described rising part in the second fitting part 221 formed at one longitudinal end of the stay side-surface 220.

The second fitting part 221 is further formed by cutting out the stay side-surface 220 in another longitudinal end of the stay side-surface 220 by a predetermined dimension from the stay bending tip 223 of the stay side-surface 220 in the transverse direction (−Y direction). Subsequent to forming of the second fitting part 221, a second side-recessed part 221*d* is formed to have a dimension to which a second side-recessed part of adjacent another stay-fixing part 20 is insertable. Further, a third side-convex part 221*e* is formed in the second fitting part 221 to be fitted into the first side-recessed part 221*b* of the opposing second fitting part 221 of another stay-fixing part 20. The third side-convex part 221*e* is formed by cutting out the stay side-surface 220 from a position of the second side-recessed part 221*d* toward the longitudinal end of the of the stay side-surface 220. Further, a fourth side-convex part 221*f* is formed on the mounting surface 210 side of the position in which the third side-convex part 221*e* is formed so that a longitudinal end of the fourth side-convex part 221*f* protrudes outward in the –X direction.

A second side-convex part 221*c* is formed at the longitudinal end of a cutout part of the stay side-surface 220 in the second fitting part 221 formed at one longitudinal end of the stay-fixing part 20. Further, a fourth side-convex part 221*f* is formed at the cutout part in another longitudinal end of the stay side-surface 220 in the second fitting part 221 formed at another longitudinal end of the stay-fixing part 20. The second side-convex part 221*c* is formed to be slightly raised inward in the Z direction from the stay side-surface 220. Further, the fourth side-convex part 221*f* is formed to have a dimension to be fitted to the recess 221*h* formed at a position adjacent to the second side-convex part 221*c*.

Thus, the second side-convex part 221*c* of one stay-fixing part 20 is fitted and entered inside the stay side-surface 220 of another stay-fixing part 20 adjacent to the one stay-fixing part 20 when the stay-fixing parts 20 are fitted. The fourth side-convex part 221*f* formed on the stay side-surface 220 of another stay-fixing part 20 is fitted into the recess 221*h* formed at a position adjacent to the second side-convex part 221*c* of the one stay-fixing part 20. This facilitates determining the fitting position of the stay-fixing parts 20 when the stay-fixing parts 20 are fitted and joined.

As described above, a so-called "joint shape" is applied to a fitting structure of the stay-fixing part 20. The stay-fixing part 20 has a high rigidity structure that hardly deform when an external force in the Z direction in the XZ plane is applied to the stay-fixing part 20 as described below. Further, the fitting structure of the stay-fixing part 20 has a high rigidity that can reduce a deformation of the stay-fixing part 20 when an external force is applied to the jointed stay-fixing parts 20 in the Y direction in the XY plane.

[Configuration of Carriage Guide End-Parts 11 (11*a* and 11*b*)]

Figure 5A:
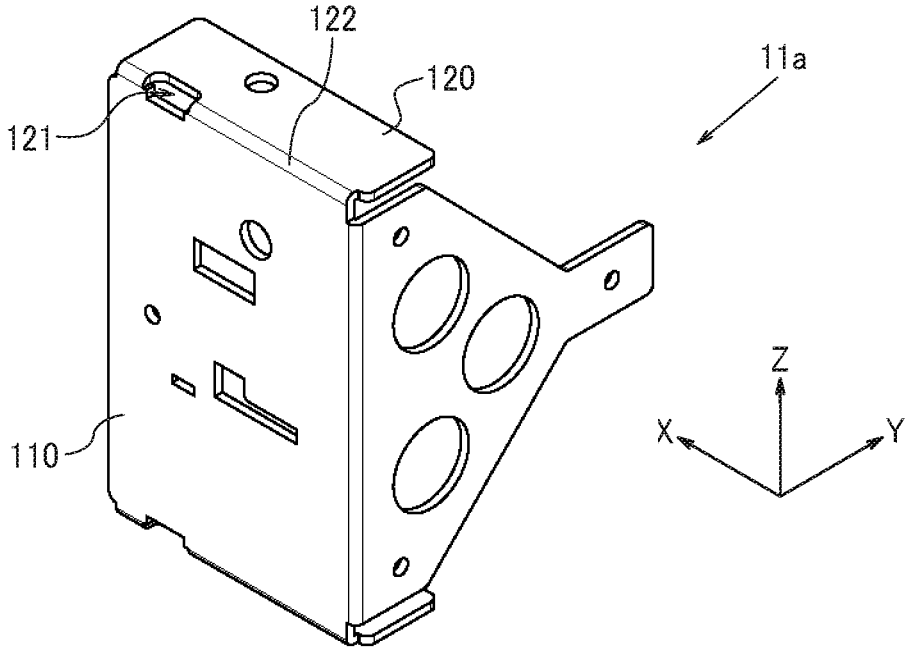
FIGS. 5A and 5B are perspective views of an embodiment of another part as one of the components of the stay rod.
Figure 5B:
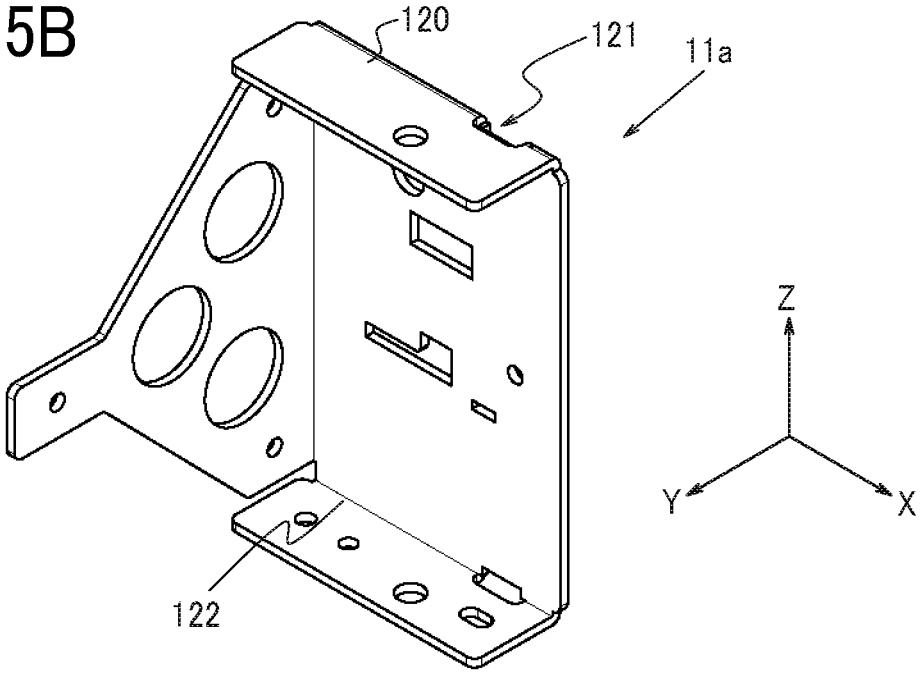

FIGS. 5A and 5B are perspective views of the carriage guide end-part 11*a*. The carriage guide end-part 11*a* is used at a right-end (–X direction end) of the carriage guide 100 of the stay rod 1 in FIG. 1.

Figure 6A:
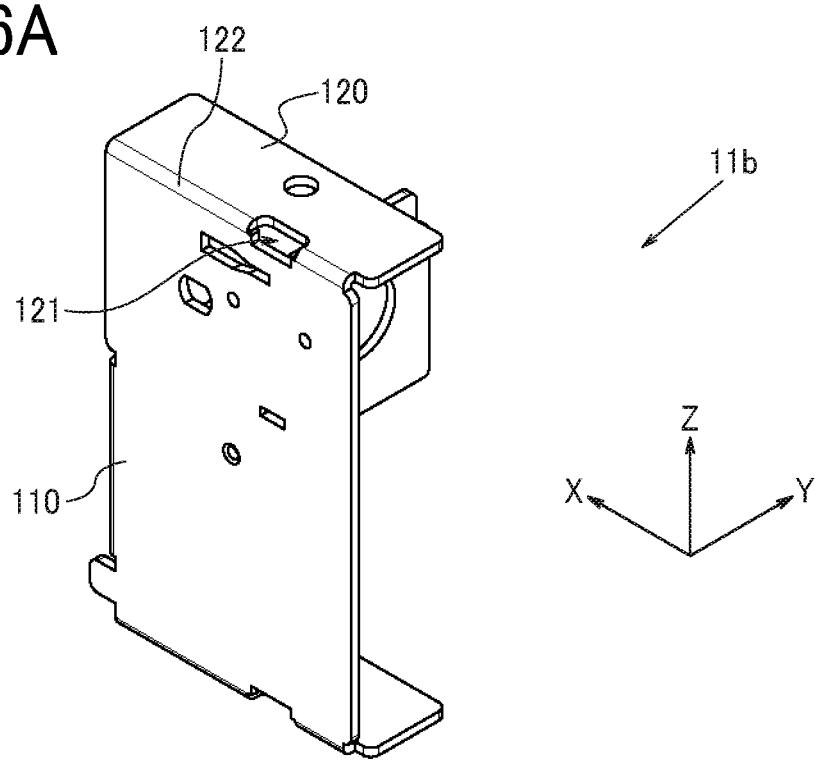
FIGS. 6A and 6B are perspective views of an embodiment of still another part as one of the components of the stay rod.
Figure 6B:
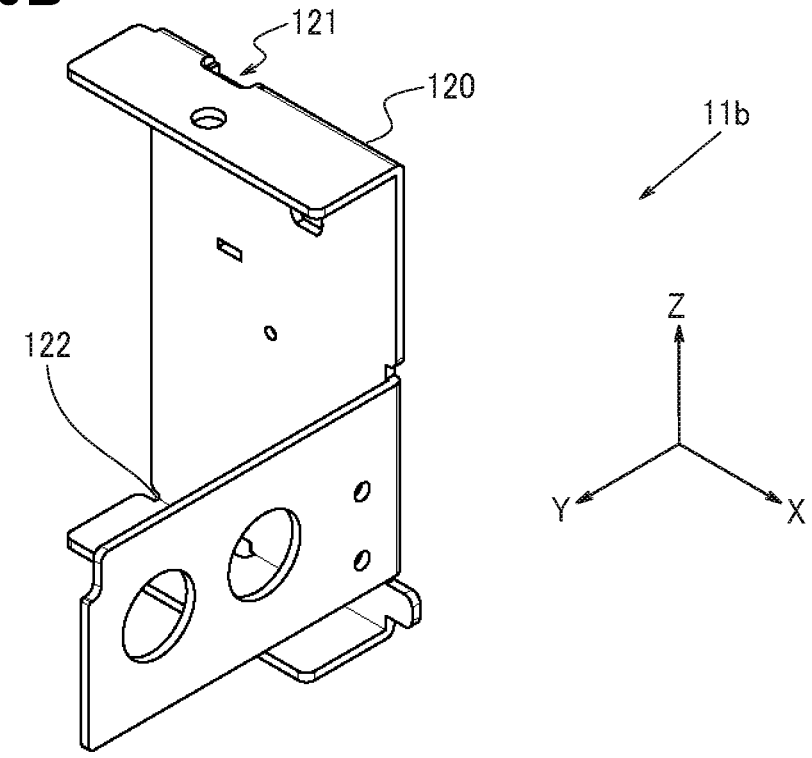

FIGS. 6A and 6B are perspective views of the carriage guide end-part 11*b*. The carriage guide end-part 11*b* is used at an end of the stay rod 1 on a left end (+X direction end) of the carriage guide 100 of the stay rod 1 in FIG. 1.

Each of the carriage guide end-parts 11 (11 *a* and 11 *b*) includes a guide surface 110 and a guide side-surface 120 as in the carriage guide part 10 (see FIGS. 3A and 3B). Further, the carriage guide end-parts 11 (11 *a* and 11 *b*) includes a hole 121 formed in a guide-bending inner part 122 that forms a boundary between the guide surface 110 and the guide side-surface 120. The hole 121 is formed along the guide-bending inner part 122 in the longitudinal direction of the guide side-surface 120. Further, the hole 121 of the carriage guide end-part 11 (11*a*, 11*b*) is formed at a position apart from both ends of the guide side-surface 120 in the longitudinal direction of the guide side-surface 120 (X direction).

[Configuration of Stay Fixing End-Parts 21 (21*a* and 21*b*)]

Figure 7A:
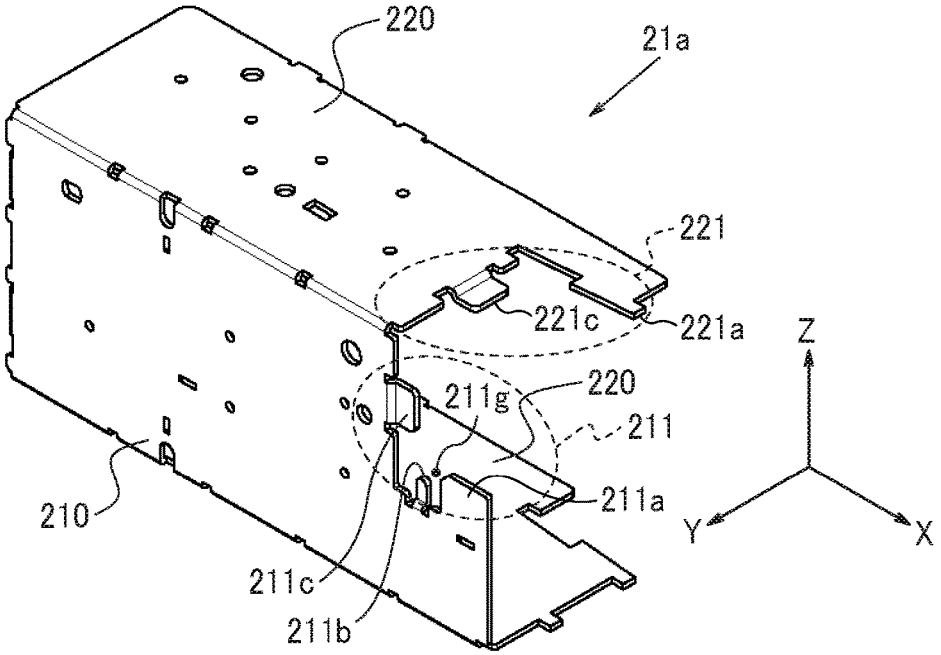
FIGS. 7A and 7B are perspective views of an embodiment of still another part as one of the components of the stay rod.
Figure 7B:
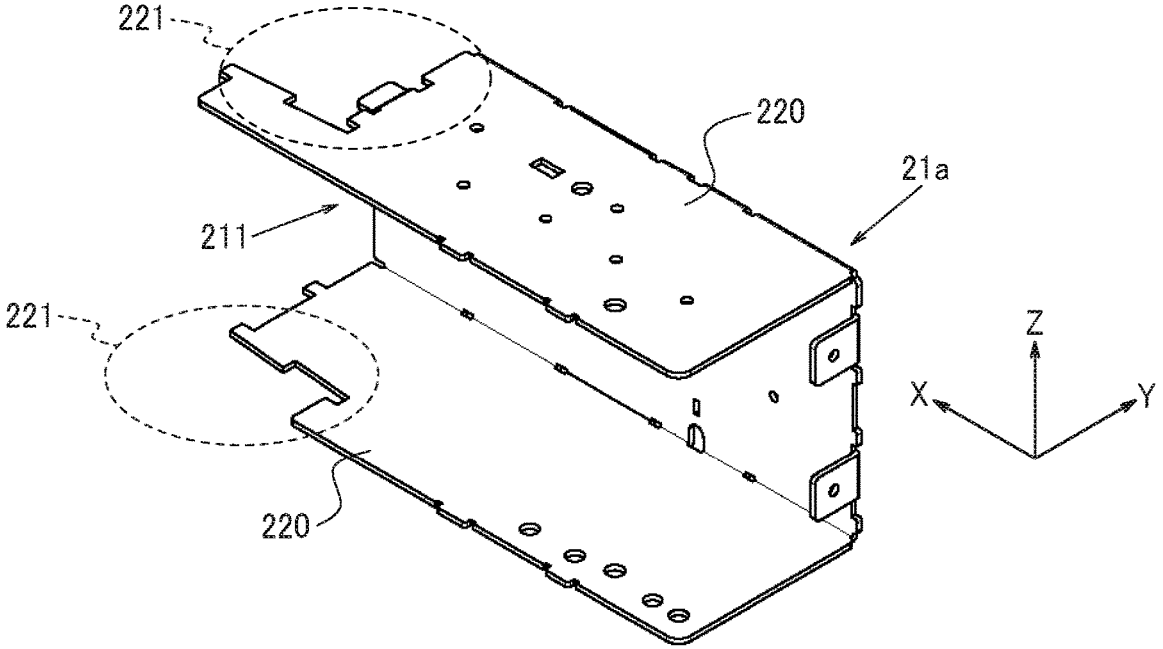

FIGS. 7A and 7B are perspective views of the stay fixing end-part 21*a*. The stay fixing end-part 21*a* is used at a right-end (–X direction end) of the stay attachment 200 of the stay rod 1. The stay fixing end-part 21*a* faces the carriage guide part 10 and the carriage guide end-part 11*a* of the carriage guide 100.

Figure 8A:
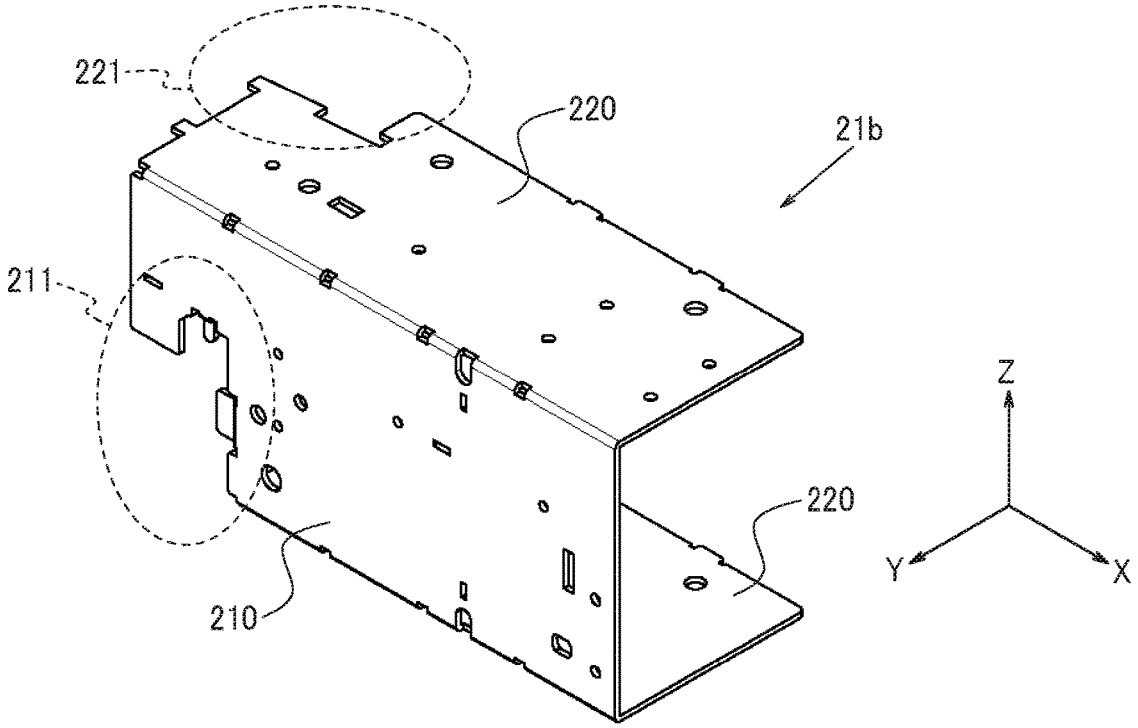
FIGS. 8A and 8B are perspective views of an embodiment of still another part as one of the components of the stay rod.
Figure 8B:
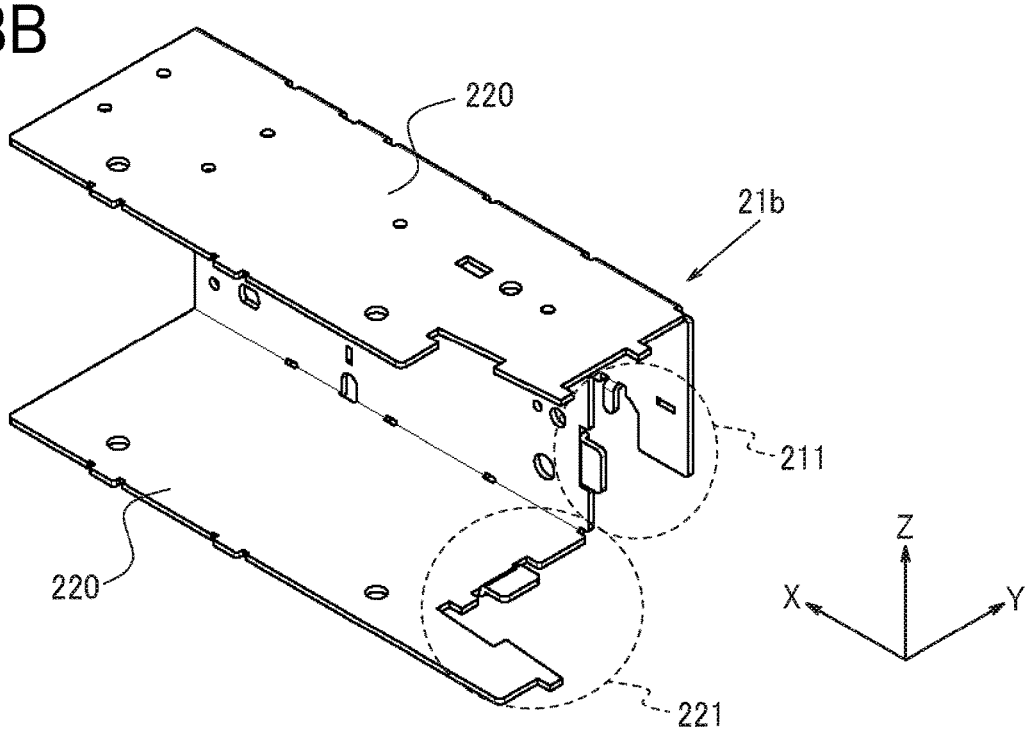

FIG. 8A and FIG. 8B are perspective views of the stay fixing end-part 21*b*. The stay fixing end-part 21*b* is used at a left-end (+X direction end) of the stay attachment 200 of the stay rod 1. The stay fixing end-part 21*a* faces the carriage guide part 10 and the carriage guide end-part 11*a* of the carriage guide 100.

Each of the stay fixing end-parts 21 (21*a* and 21*b*) includes a mounting surface 210 and a stay side-surface 220 in the same manner as the stay-fixing part 20. Further, a first fitting part 211 is formed at one end of the mounting surface 210 of the stay fixing end-part 21 (21*a* and 21*b*) in the longitudinal direction of the mounting surface 210. Further, a second fitting part 221 is formed at one end of the stay side-surface 220 of the stay fixing end-part 21 (21*a* and 21*b*) in the longitudinal direction of the stay side-surface 220.

[Assembly Structure of Stay Rod 1]

Figure 9A:
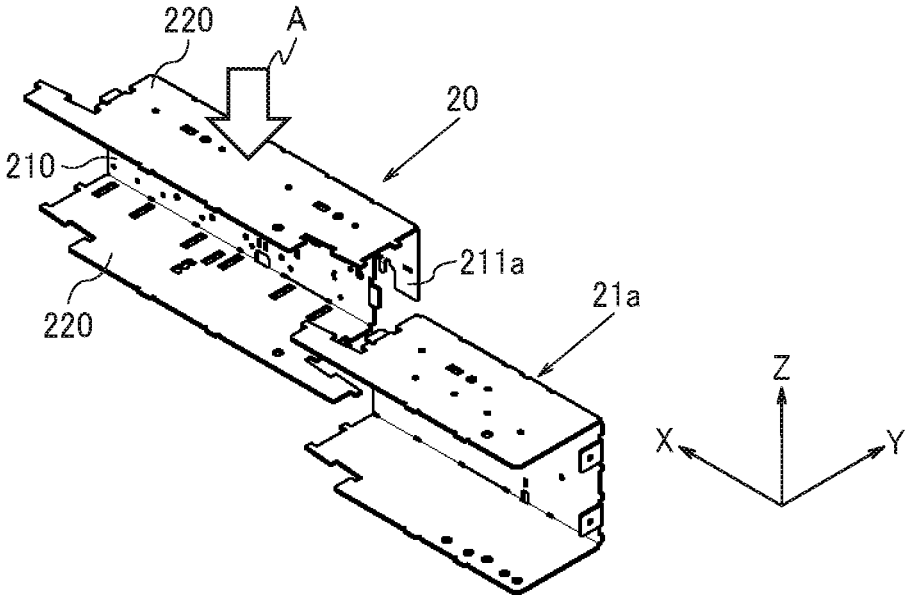
FIGS. 9A to 9C are perspective views of the second parts to illustrate a part of an assembly process of the stay rod.

An assembly structure of the stay rod 1 is described below. First, as illustrated in FIG. 9A, the stay fixing end-part 21*a* and the stay-fixing part 20 are joined together. As indicated by arrow A, the convex surface part 211*a* of the stay fixing end-part 21*a* (see FIG. 7A) is inserted into the recess 211*g* of the stay-fixing part 20 so that the stay fixing end-part 21*a* slides into the stay-fixing part 20 in the "–Z direction". Thus, the first convex part 211*b* and the second convex part 211*c* of the stay-fixing part 20 (see FIG. 4B) restrict movement of the inserted convex surface part 211*a* of the stay fixing end-part 21*a* in a direction away from the mounting surface 210 of the stay-fixing part 20.

Figure 9B:
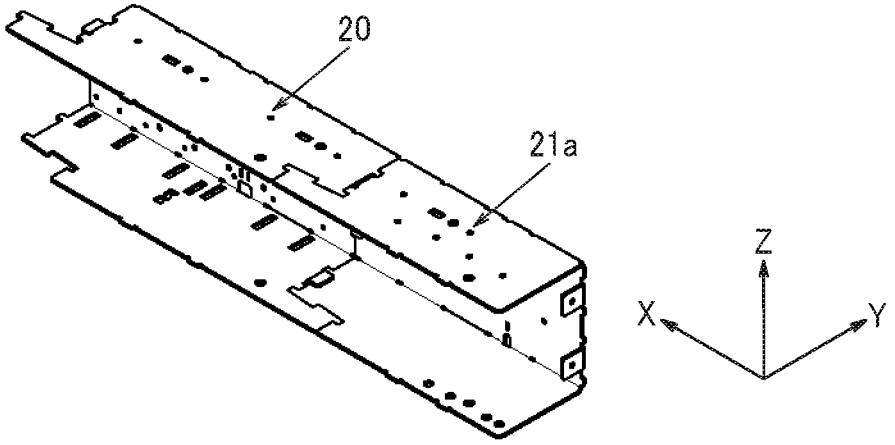

Thus, the convex surface part 211*a* of the stay-fixing part 20 and the convex surface part 211*a* of the stay fixing end-part 21*a* are fitted and engaged with each other. Further, when the convex surface part 211*a* of the stay fixing end-part 21*a* is slid and fitted to the recess 211*g* of the stay-fixing part 20, the second fitting part 221 of the stay fixing end-part 21*a* and the second fitting part 221 of the stay-fixing part 20 are also fitted and engaged with each other. Thus, the process as described above forms a structure illustrated in FIG. 9B. Then, as illustrated by arrow B in FIG. 9C, the stay-fixing part 20 is further joined to the structure of FIG. 9B and is extended in the longitudinal direction of the stay-fixing part 20 (X direction).

Figure 9C:
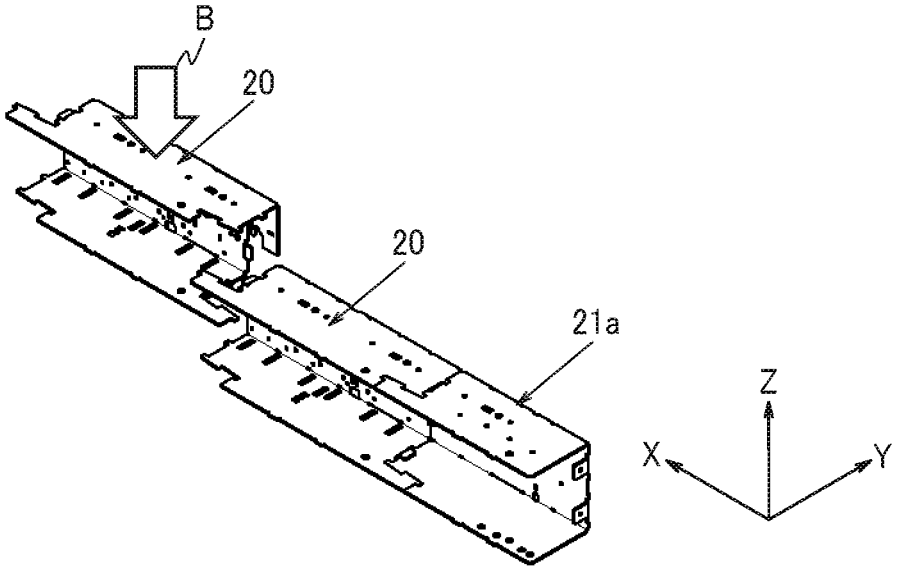
Figure 10A:
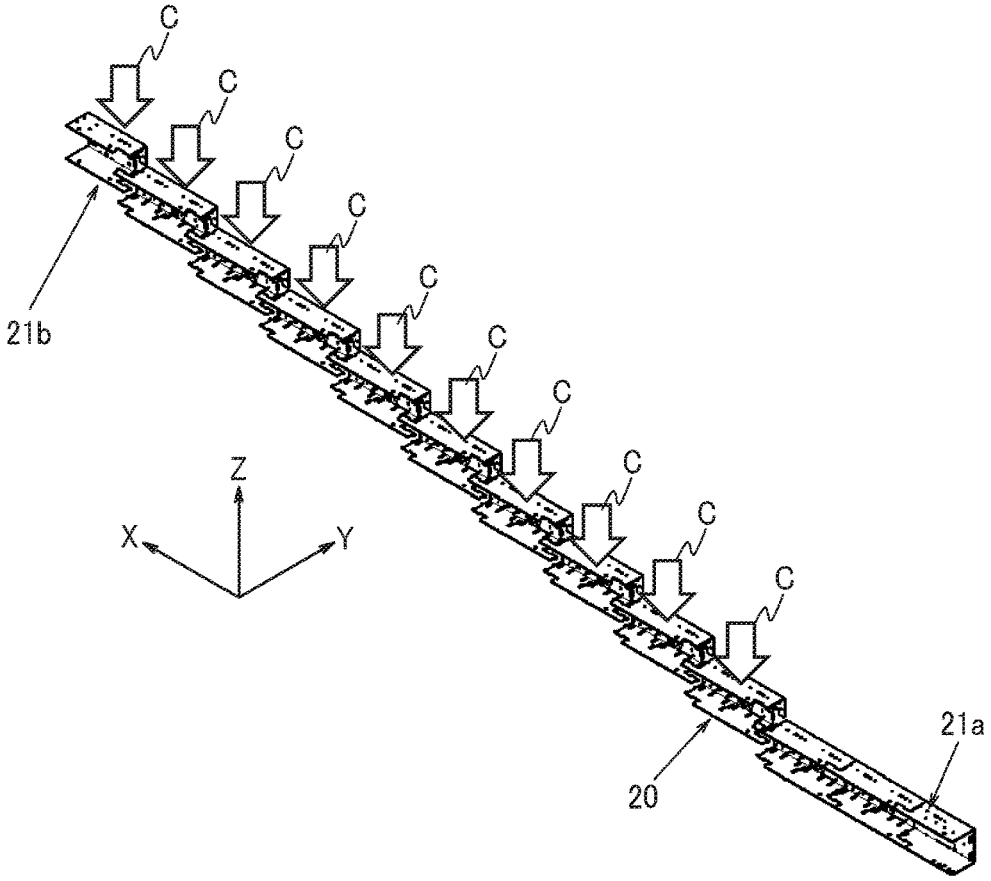
FIGS. 10A and 10B are perspective views of the second parts to illustrate a part of the assembly process of the stay rod.
Figure 10B:
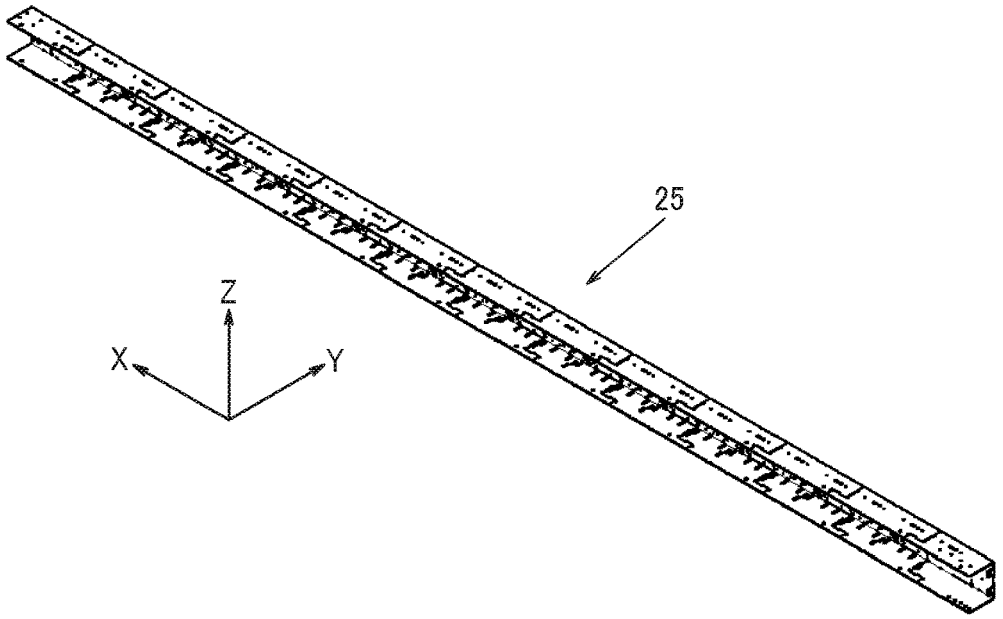

Further, as illustrated by arrows C in FIG. 10A from the state illustrated in FIG. 9C, the stay-fixing parts 20 are sequentially fitted and joined in the longitudinal direction of the stay-fixing part 20. Finally, the stay fixing end-part 21*b* is fitted and joined in another end of the structure opposite the one end of the structure to which the stay fixing end-part 21*a* is fitted and joined as illustrated in FIG. 10A. Thus, as illustrated in FIG. 10B, an elongated part (C-channel elongated part 25) having a predetermined length and a "C-channel" cross section is formed.

Figure 11A:
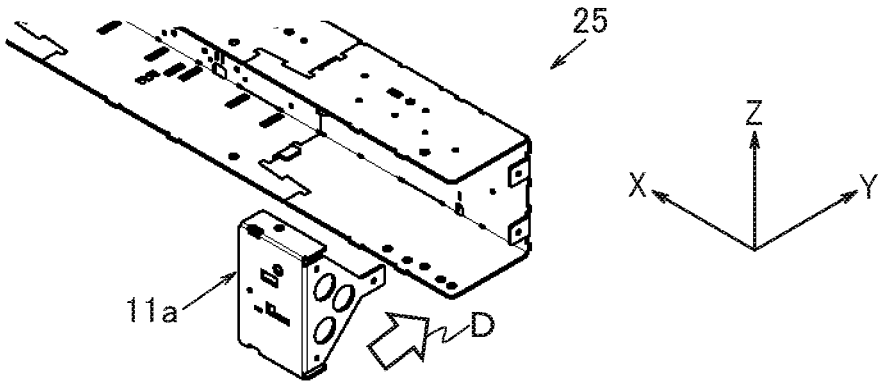
FIGS. 11A to 11D are perspective views of the first parts and the second parts to illustrate a part of the assembly process of the stay rod.
Figure 11B:
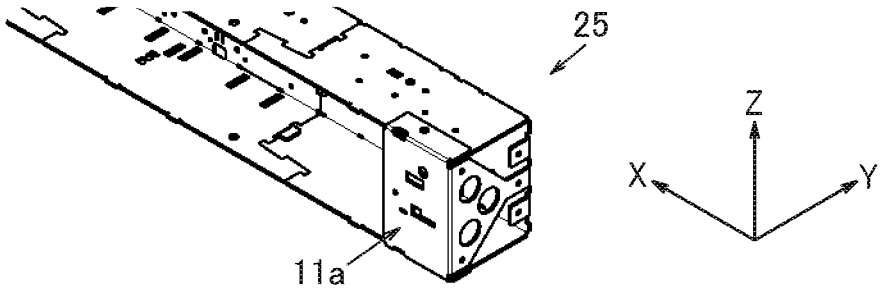
Figure 11C:
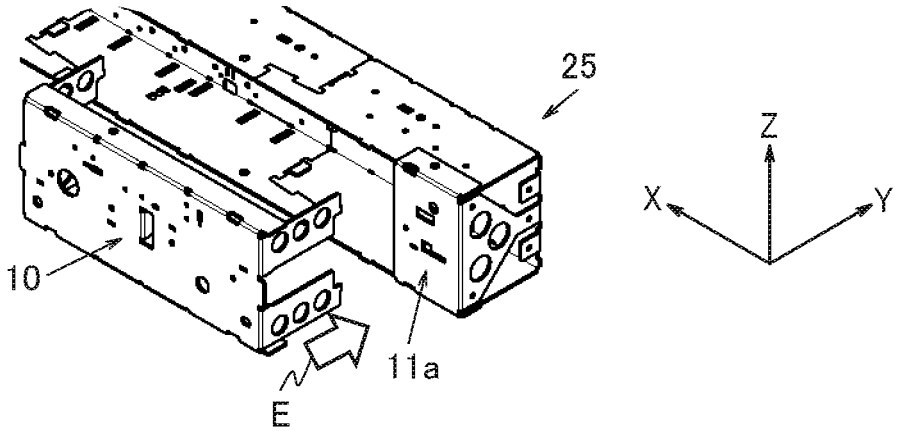
Figure 11D:
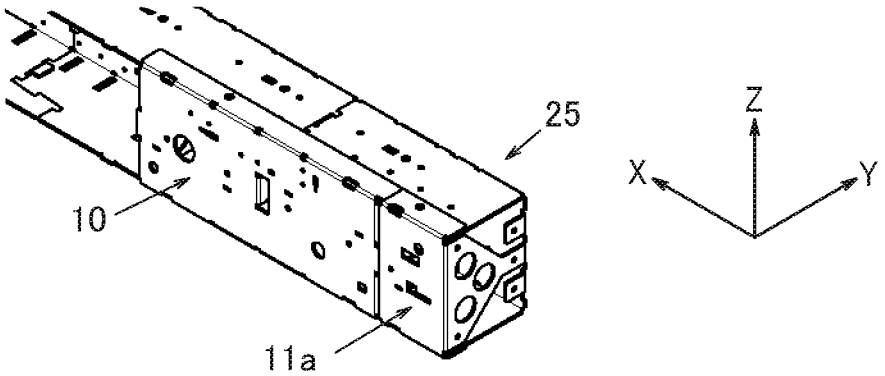

Next, as illustrated by arrow D in FIG. 11A, the carriage guide end-part 11*a* is attached to the C-channel elongated part 25 to close an opening at one end (+X direction end) of the C-channel elongated part 25 in the longitudinal direction of the C-channel elongated part 25. The attached state of the carriage guide end-part 11*a* to the C-channel elongated part 25 is as illustrated in FIG. 11B. Then, as illustrated by arrow E in FIG. 11C, the carriage guide part 10 is attached at a position adjacent to the carriage guide end-part 11*a* to close the opening of the C-channel elongated part 25. The attached state of the carriage guide part 10 to the C-channel elongated part 25 is as illustrated in FIG. 11D.

Figure 12:
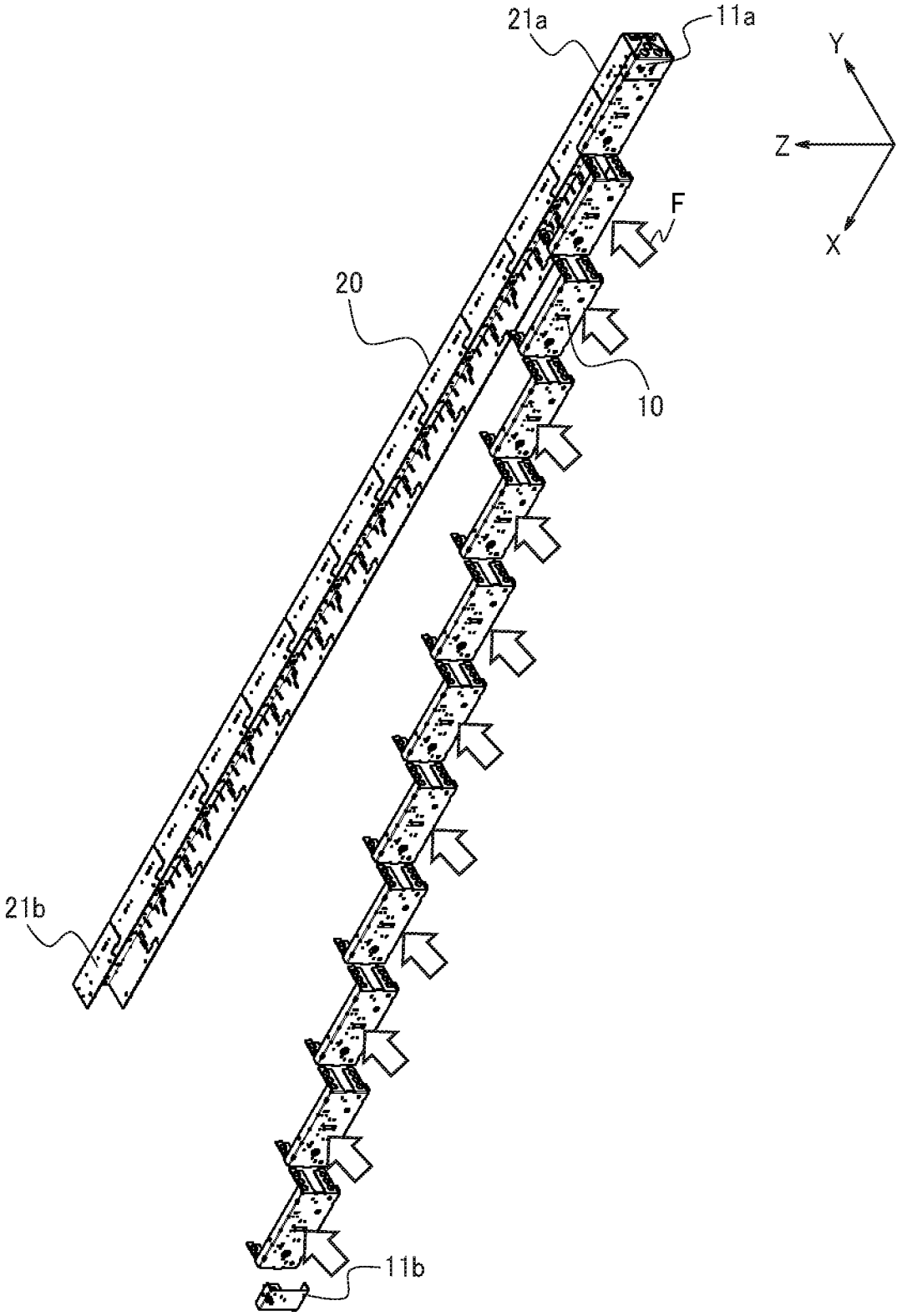
FIG. 12 is a perspective view of the first parts and the second parts to illustrate a part of the assembly process of the stay rod.

Then, as illustrated by arrow F in FIG. 12, the carriage guide parts 10 are sequentially attached to the C-channel elongated part 25 adjacent to one another to close the opening of the C-channel elongated part 25, and finally the carriage guide end-part 11*b* is attached to another end (–X direction end) of the C-channel elongated part 25. Thus, the stay rod 1 as illustrated in FIG. 1 is formed. That is, the stay rod 1 is a combination of a plurality of carriage guide parts 10 and a plurality of stay-fixing parts 20, and has an elongated box-shaped cross section.

Figure 13:
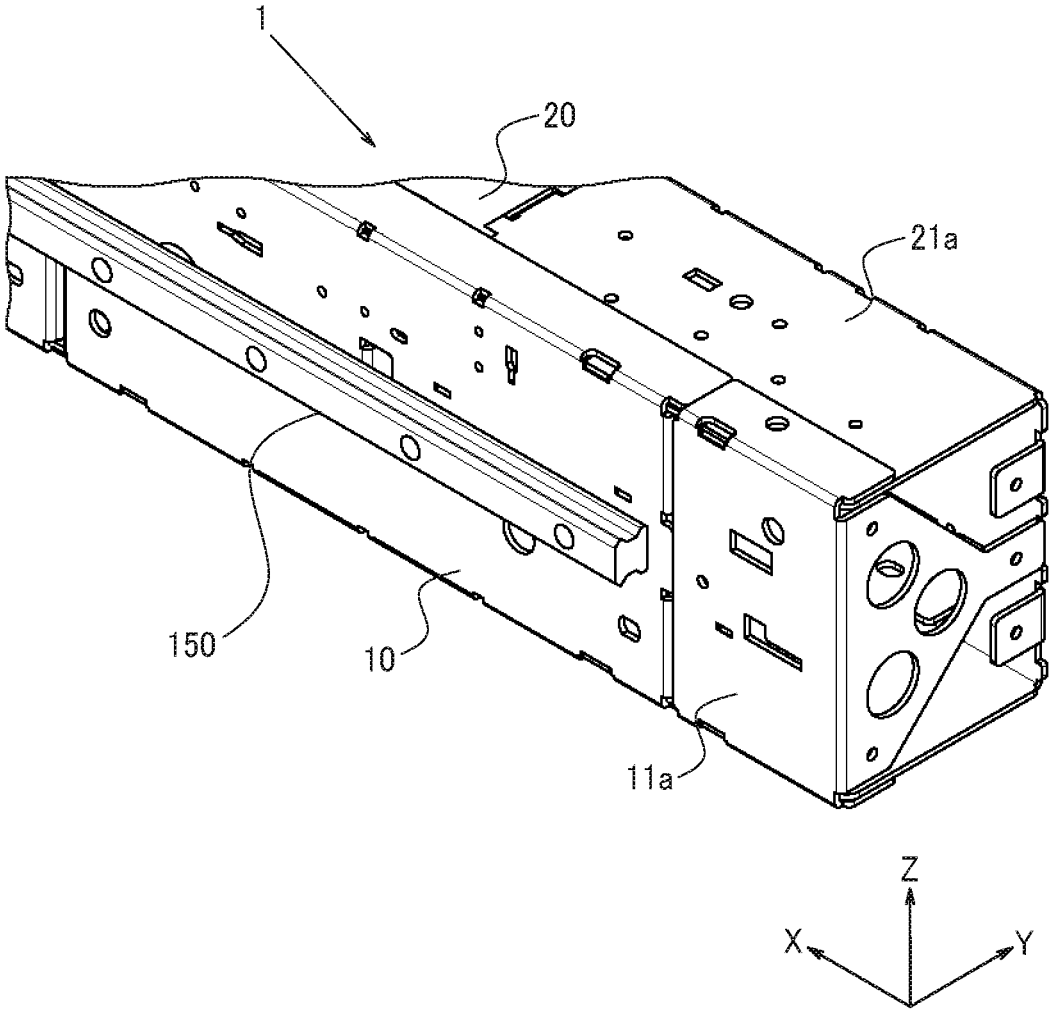
FIG. 13 is a perspective view of a guide rail used for the stay rod.

Then, a guide rail 150 to guide a sliding movement of the carriage 400 as described below is fixed to the carriage guide 100 of the stay rod 1. As illustrated in FIG. 13, the guide rail 150 is attached to the guide surface 110 of the carriage guide part 10, and the guide rail 150 is fixed near middle of the dimension of the carriage guide 100 in the Z axis direction.

[Detailed Structure of Stay Rod 1]

Figure 14A:
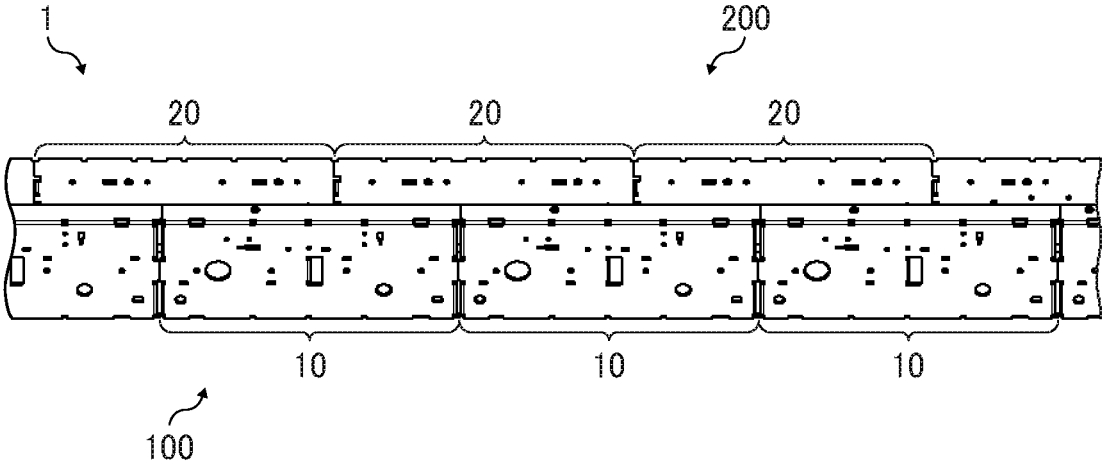
FIGS. 14A and 14B are perspective views of a fitting part of the stay rod.
Figure 14B:
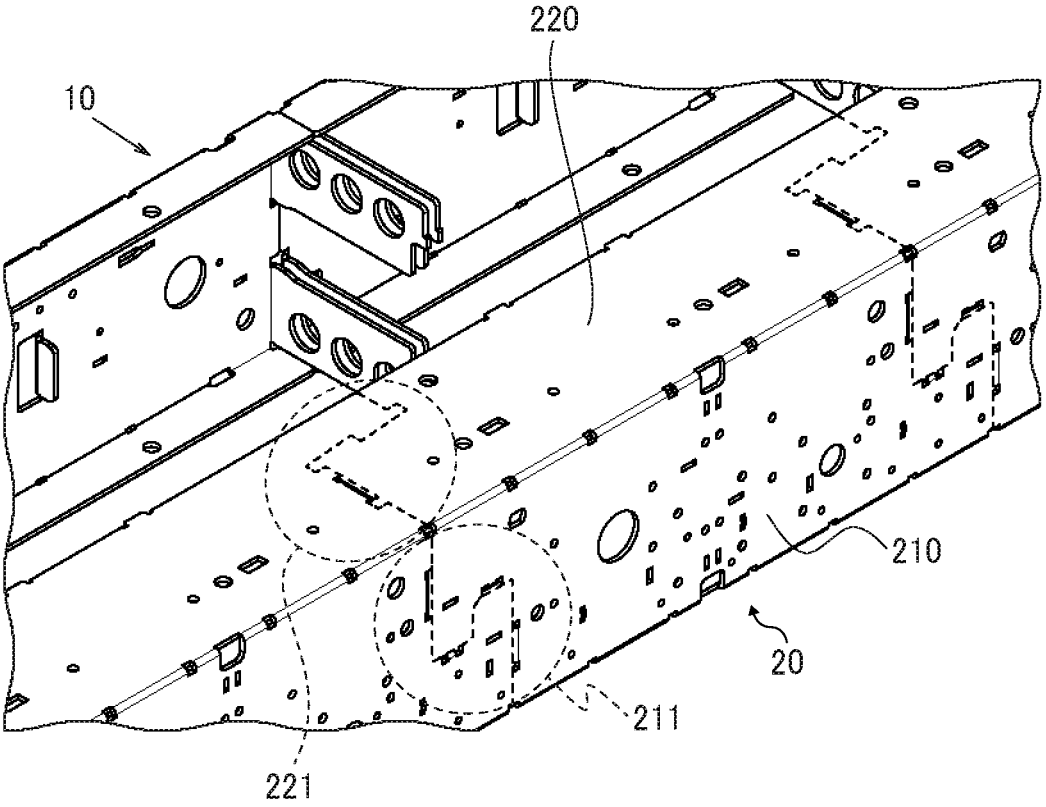

Next, an aspect of fitting and engaging each part of the carriage guide part and the stay-fixing part 20 is further described below in detail. The aspect of fitting and engaging each part is a characteristic of the structure of the stay rod 1. FIG. 14A illustrates the stay rod 1 from the carriage guide 100 side as viewed obliquely from above. FIG. 14B is an enlarged perspective view of the stay rod 1.

As illustrated in FIG. 14A, the carriage guide parts 10 are fitted and joined to the stay-fixing parts 20 such that positions of boundaries (joints) of the carriage guide parts 10 adjacent to each other in the longitudinal direction of the stay rod 1 and positions of boundaries (joints) of the stay-fixing parts 20 adjacent to each other in the longitudinal direction of the stay rod 1 are staggered (different) with each other in the longitudinal direction of the stay rod 1. Further, as illustrated in broken line in FIG. 14B, each of the joint of the stay-fixing parts 20 includes a joint structure having different shapes in each of two orthogonal surfaces (the mounting surface 210 and the stay side-surface 220). Fitting and engaging the joint structures can increase rigidity of the stay rod 1 in the longitudinal direction of the entire stay rod 1.

Figure 15A:
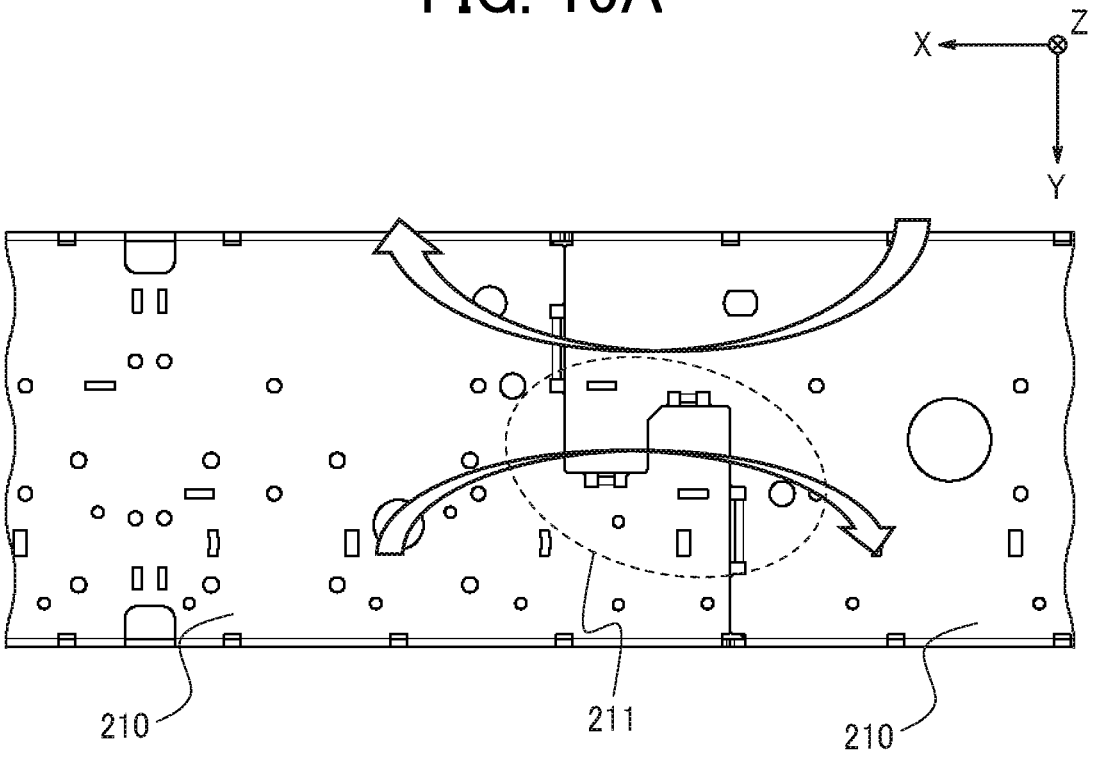
FIGS. 15A and 15B illustrate an effect of the fitting part of the stay rod.

As illustrated in FIG. 15A, the stay-fixing part 20 includes the first fitting part 211 having a structure that exerts rigidity against a force (illustrated by circular arrows in FIG. 15A) in a direction toward the stay side-surface 220. The first fitting part 211 is illustrated in FIGS. 14B and 15A by a circle with broken line as a fitting part in the longitudinal end of the mounting surface 210. Thus, the stay rod 1 can reduce an instability of the carriage guide 100 in the Y axis direction in the longitudinal direction of the stay rod 1.

Figure 15B:
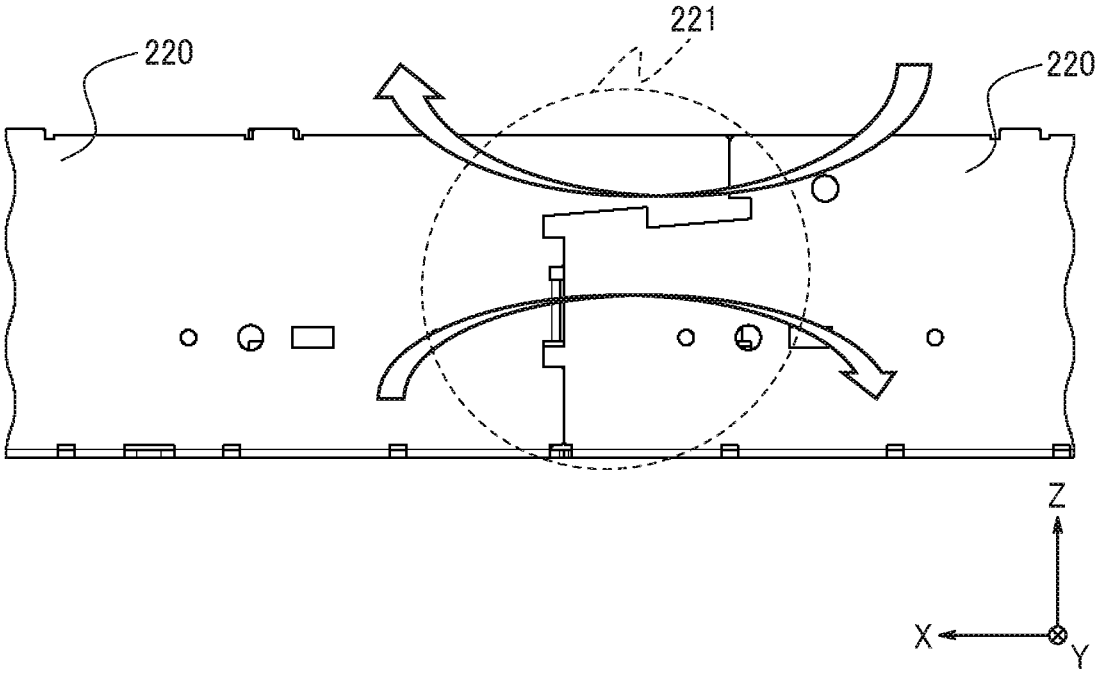

As illustrated in FIG. 15B, the stay-fixing part 20 includes the second fitting part 221 having a structure that exerts rigidity against a force (illustrated by circular arrows in FIG. 15B) in a direction toward the mounting surface 210 and opening. The second fitting part 221 is illustrated in FIGS. 14B and 15B by a circle with broken line as a fitting part in the longitudinal end of the stay side-surface 220. Thus, the stay rod 1 can reduce an instability of the carriage guide 100 in the Z axis direction in the longitudinal direction of the stay rod 1. Further, instability of the stay rod 1 in the X direction is regulated by a stay-end fixing part 403 as described below. Therefore, the stay rod 1 has a structure that exerts rigidity to reduce a load generated by the sliding movement of the carriage 400.

Figure 16:
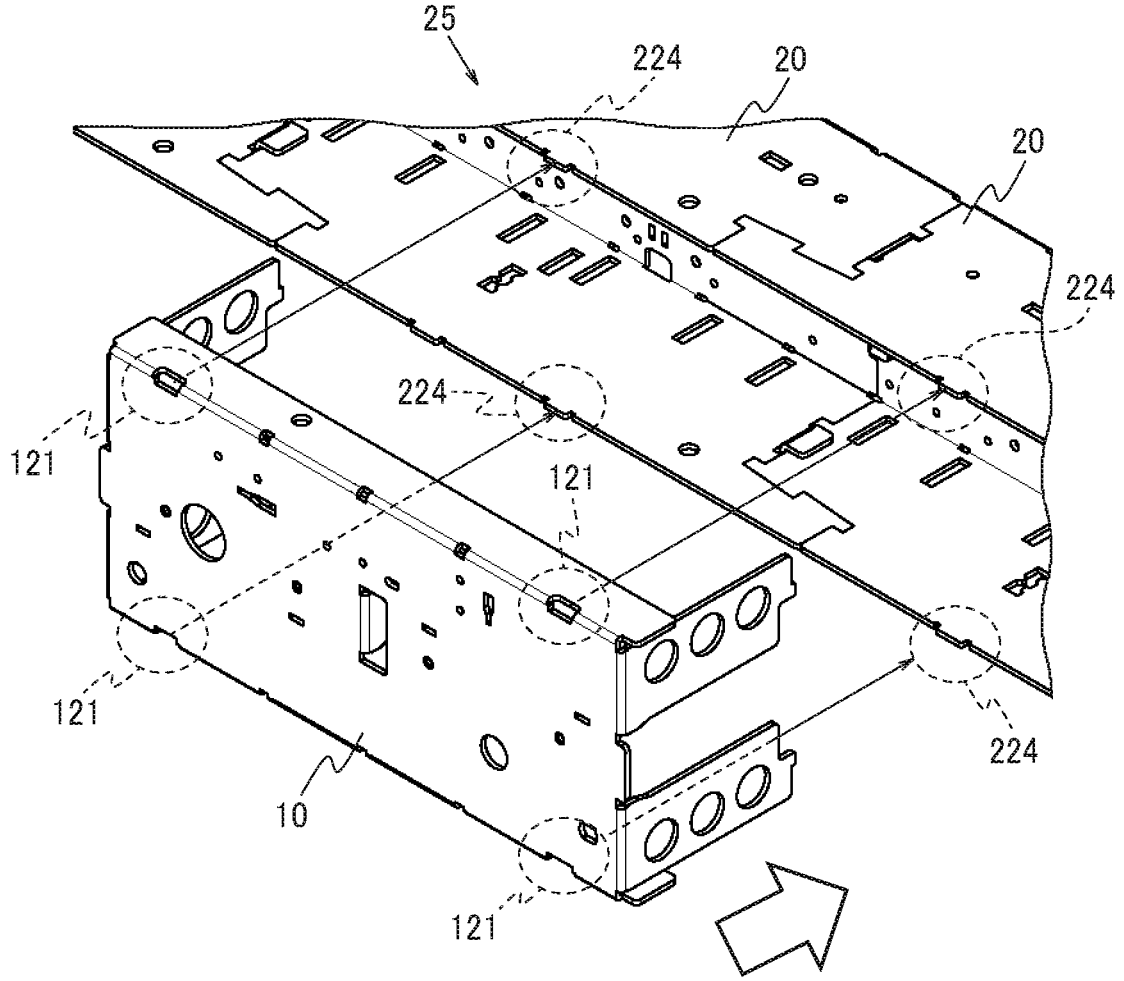
FIG. 16 is a perspective view of another fitting part of the stay rod.
Figure 17:
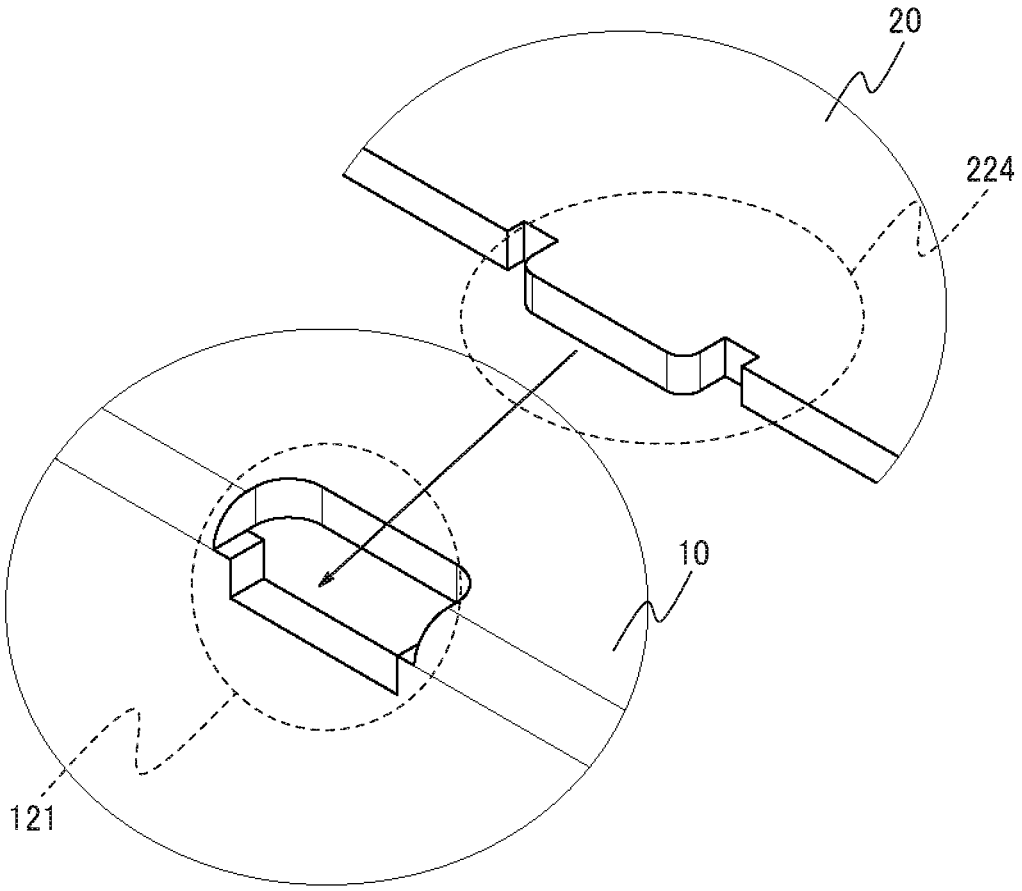
FIG. 17 is a perspective view of another fitting part of the stay rod.
Figure 18:
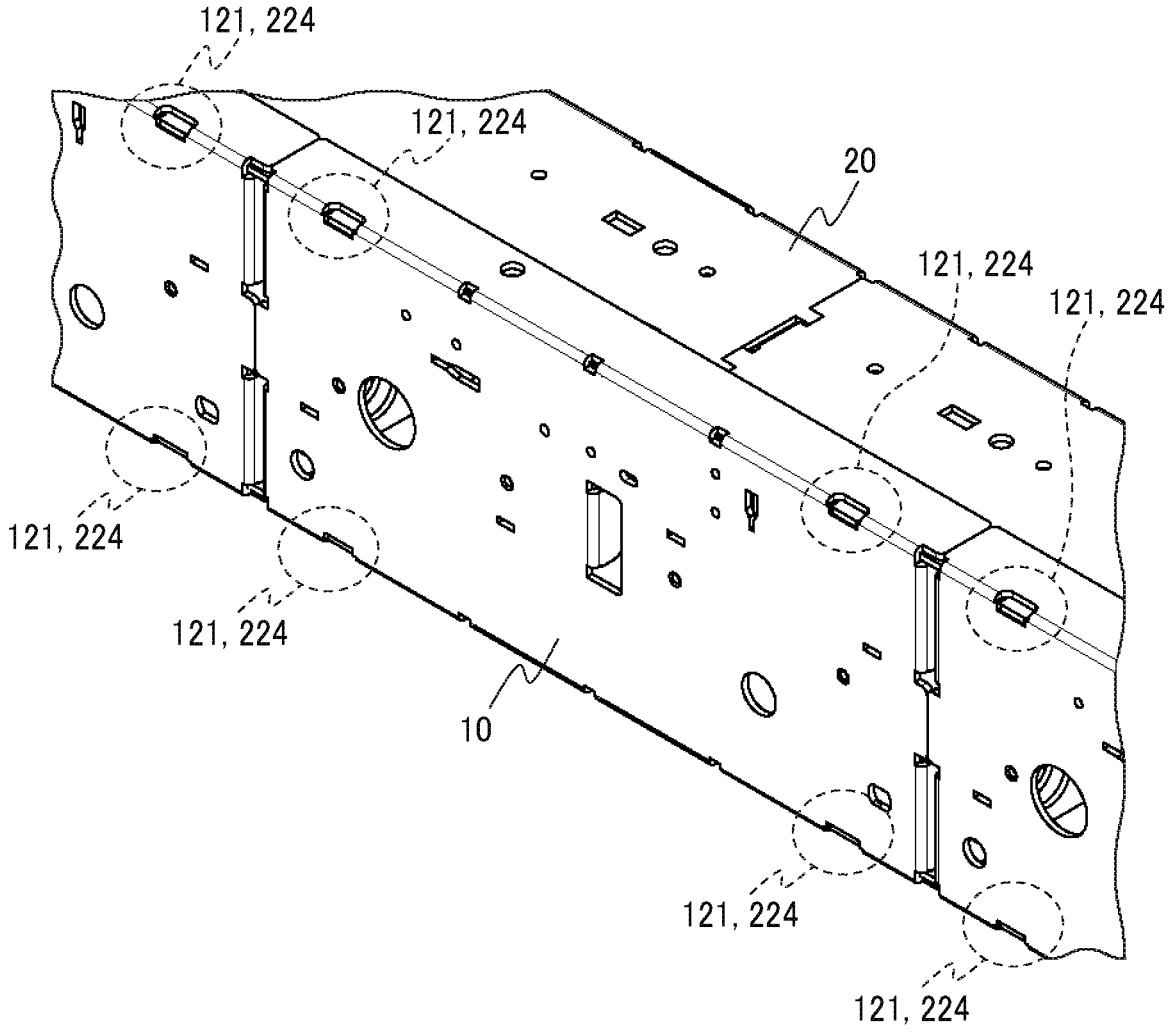
FIG. 18 is a perspective view of another fitting part of the stay rod.

Next, a mounting structure of the carriage guide part 10 is described in detail with reference to FIGS. 16, 17 and 18. As illustrated in FIG. 16, the convex part 224 of the stay-fixing part 20 fits into the hole 121 of the carriage guide part 10 so that the carriage guide part 10 is fitted into the opening of the C-channel elongated part 25. That is, as illustrated in FIG. 17, the convex part 224 is inserted into and fitted into the hole 121. Then, as illustrated in FIG. 18, the two holes 121 in one carriage guide part 10 are fitted into the convex parts 224 of two adjacent stay-fixing parts 20, respectively. Thus, one carriage guide part 10 spans the boundary (joint) of two stay-fixing parts 20 adjacent with each other. Further, one stay-fixing part 20 spans the boundary (joint) of two carriage guide parts 10 adjacent with each other.

[Improved Surface Flatness (Planar Accuracy) of Guide Surface 110]

Figure 19A:
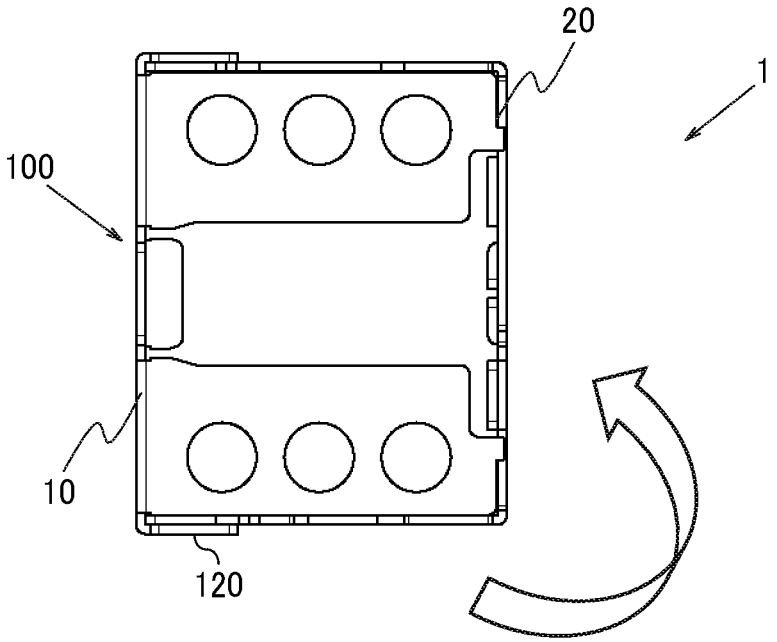
FIGS. 19A and 19B are cross-sectional views of a configuration to improve a surface flatness of a carriage holding surface of the stay rod.
Figure 19B:
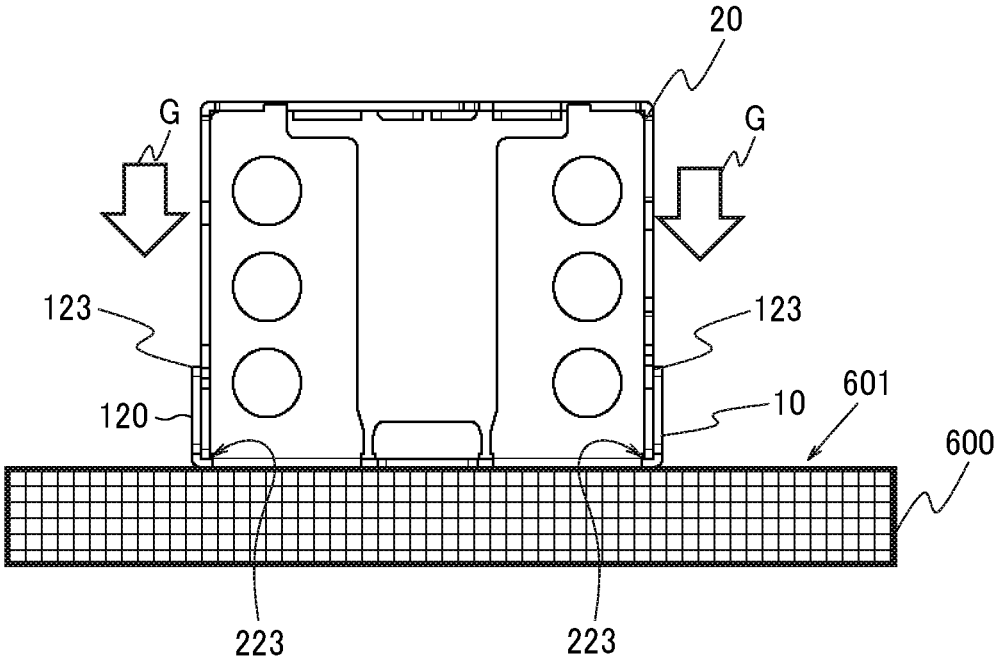

Next, a method of enhancing surface flatness (planar accuracy) of the guide surface 110 of the stay rod 1 is described with reference to FIGS. 19A and 19B. As illustrated in FIG. 19A, the stay rod 1 in which the carriage guide part 10 is fitted into the C-channel elongated part 25 as illustrated in FIG. 19A is rotated by 90 degrees around X-axis as a rotational axis as illustrated in FIG. 19B, to direct the carriage guide 100 toward a direction of gravity (downward). The stay rod 1 is mounted on a high-precision jig surface 601 of a jig 600 as a flat member in the state in which the carriage guide 100 faces downward (direction of gravity). The high-precision jig surface 601 is a surface having the surface flatness required for the carriage guide 100.

In the state illustrated in FIG. 19B, the stay bending tip 223 presses and contacts (abuts) the guide-bending inner part 122 when a force in a direction indicated by arrow G is applied to the stay rod 1. Then, each of the guide-bending inner part 122 of the carriage guide part 10 is uniformly pushed in the direction of arrow G by the rigidity of a connected object of the stay-fixing parts 20 (C-channel elongated parts 25). Then, each guide surface 110 of the carriage guide part 10 is pressed against the high-precision jig surface 601.

A dimension (width) of the guide side-surface 120 of the carriage guide part 10 is shorter than the dimension (width) of the stay side-surface 220 of the stay-fixing part 20. Thus, the rigidity of the carriage guide part 10 is lower than the rigidity of the stay-fixing part 20. Thus, when the stay rod 1 is pressed against the a high-precision jig surface 601 with the force applied in the direction indicated by arrow G, the guide surface 110 follows the a high-precision jig surface 601, and the surface flatness of the a high-precision jig surface 601 is transferred to each guide surface 110. When the guide bending tip 123 and the stay side-surface 220 of the stay-fixing part 20 are fixed in a state in which the surface flatness of the high-precision jig surface 601 is transferred to each guide surface 110, the carriage guide 100 can be formed to have a surface with high surface flatness.

[Fastening Structure of Carriage Guide Part 10 and Stay-Fixing Part 20]

Figure 20:
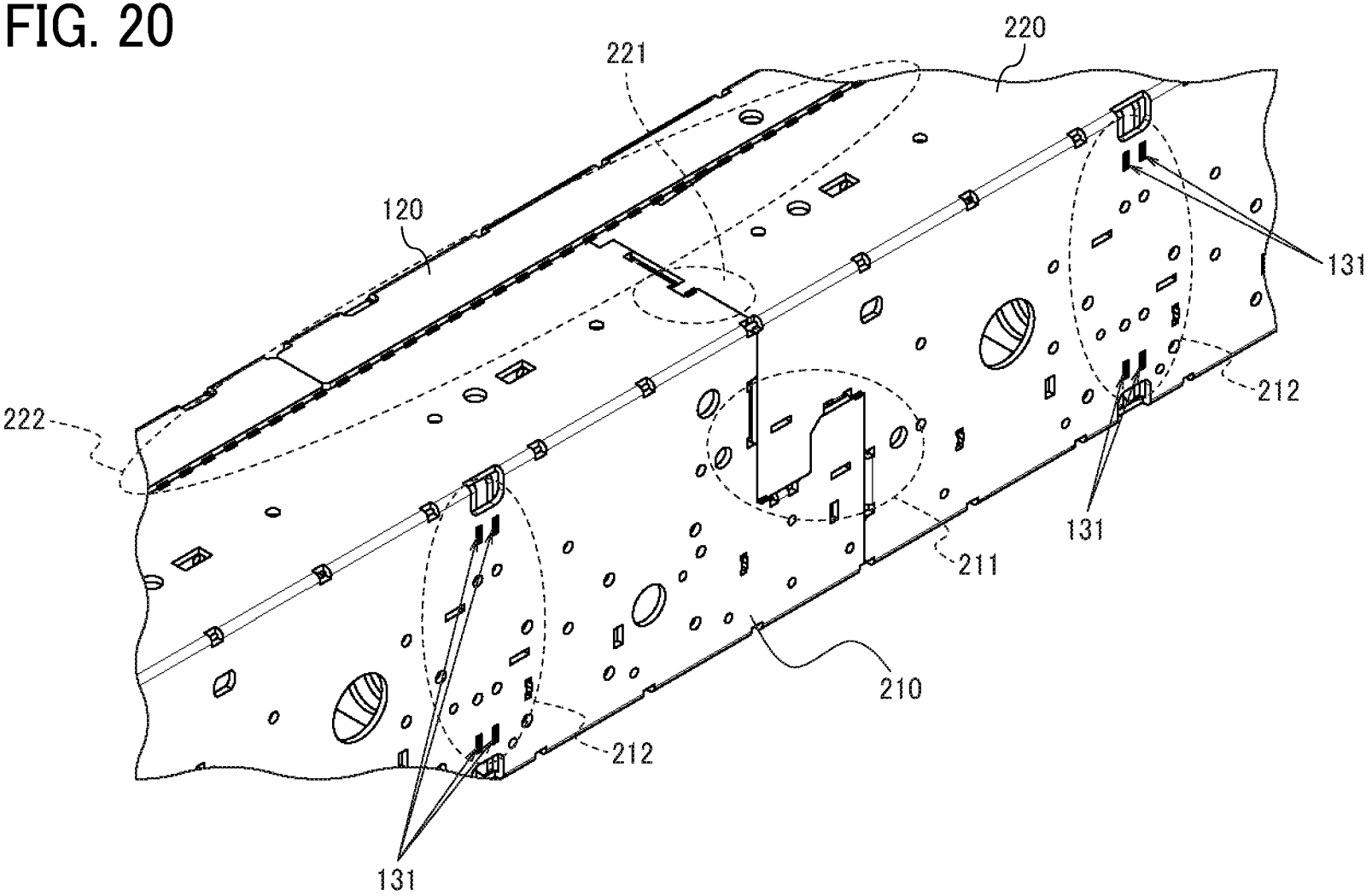
FIG. 20 is a perspective view of a fastening structure of the fitting part of the stay rod.

Next, the fastening structure of each part in the stay rod 1 is described below in detail. As illustrated in FIG. 20, the stay rod 1 includes a side-surface fastening part 222 formed over the entire length in the longitudinal direction of the stay rod 1 in a part in which the guide bending tip 123 of the carriage guide part 10 contacts (abuts) the stay side-surface 220 of the stay-fixing part 20. The side-surface fastening part 222 is formed by laser welding spaced apart by a constant distance in a longitudinal direction of a side surface of the stay rod 1.

Fastening by laser welding is performed to a contact portion between the adjacent stay-fixing parts 20 in the longitudinal direction of the stay rod 1 in the second fitting part 221. The second fitting part 221 is a fitting part of the stay side-surface 220.

Fastening by laser welding is performed to a contact portion between the adjacent stay-fixing parts 20 in the longitudinal direction of the stay rod 1 similarly in the first fitting part 211. The first fitting part 211 is a fitting part of the mounting surface 210.

Figure 21:
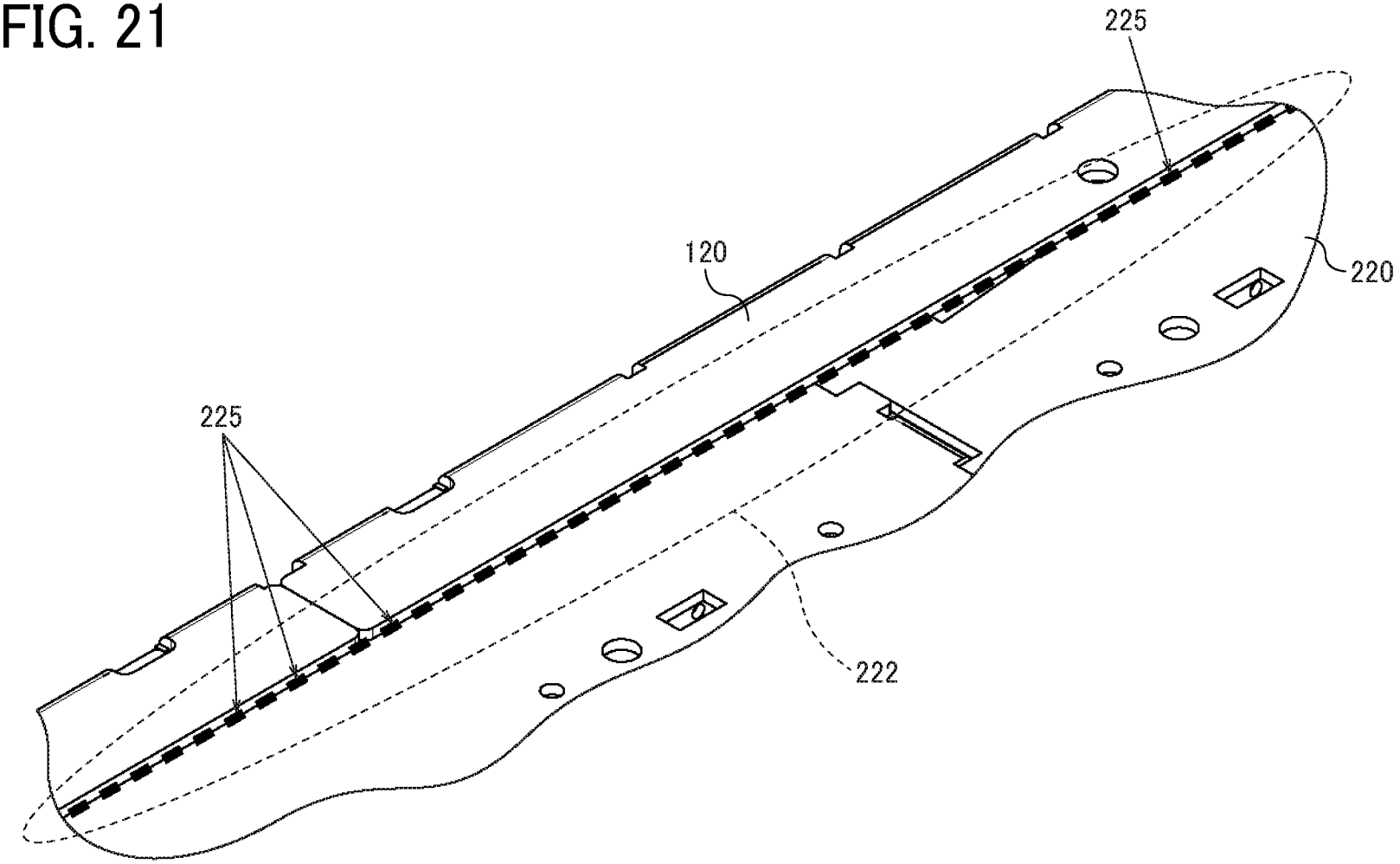
FIG. 21 is an enlarged perspective view of the fastening structure of the fitting part of the stay rod.

Next, a fastening structure of the first fitting part 211 and the second fitting part 221, and a fastening structure of the carriage guide part 10 and the stay-fixing part 20 are further described in detail with reference to FIGS. 21 to 24. FIG. 21 is a partially enlarged perspective view of a side-surface fastening part 222. As illustrated in FIG. 21, a side-surface fastening part 222 is formed by laser welding with a constant interval over the entire length of the side surface of the stay rod 1 in the longitudinal direction of the stay rod 1. That is, the side-surface fastening part 222 fastens the carriage guide part 10 and the stay-fixing part 20 by a laser-pulse welding part 225.

Figure 22:
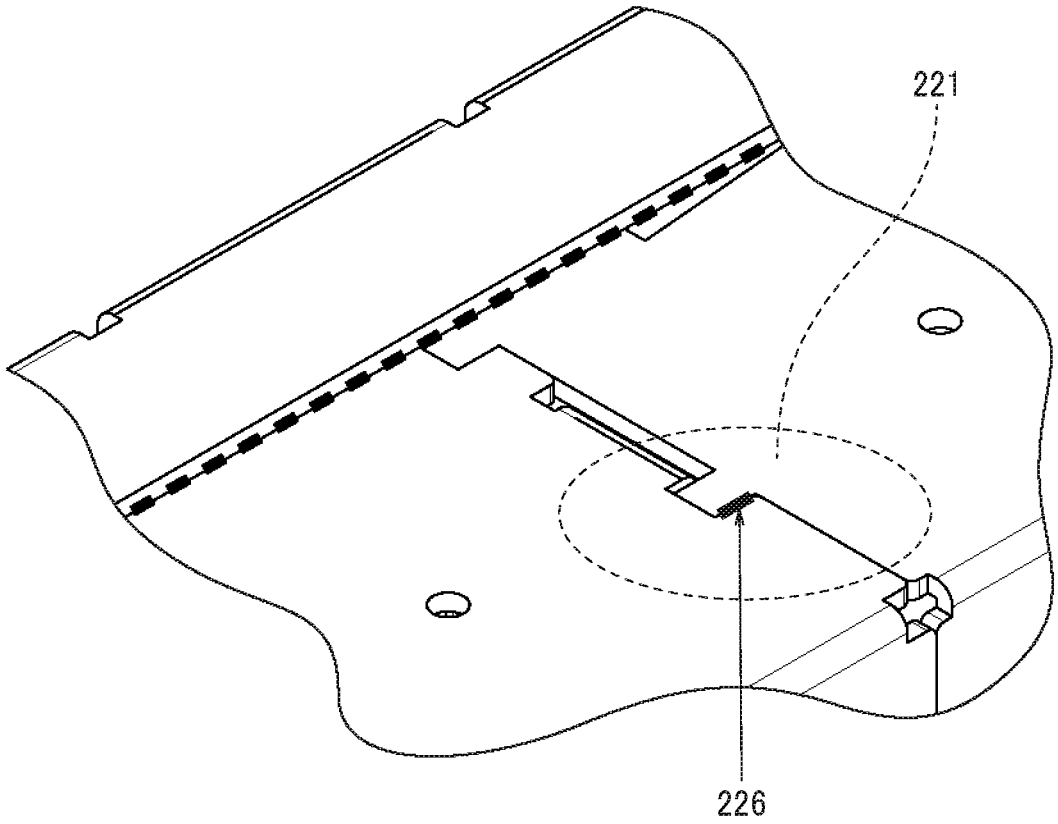
FIG. 22 is an enlarged perspective view of the fastening structure of the fitting part of the stay rod.
Figure 23:
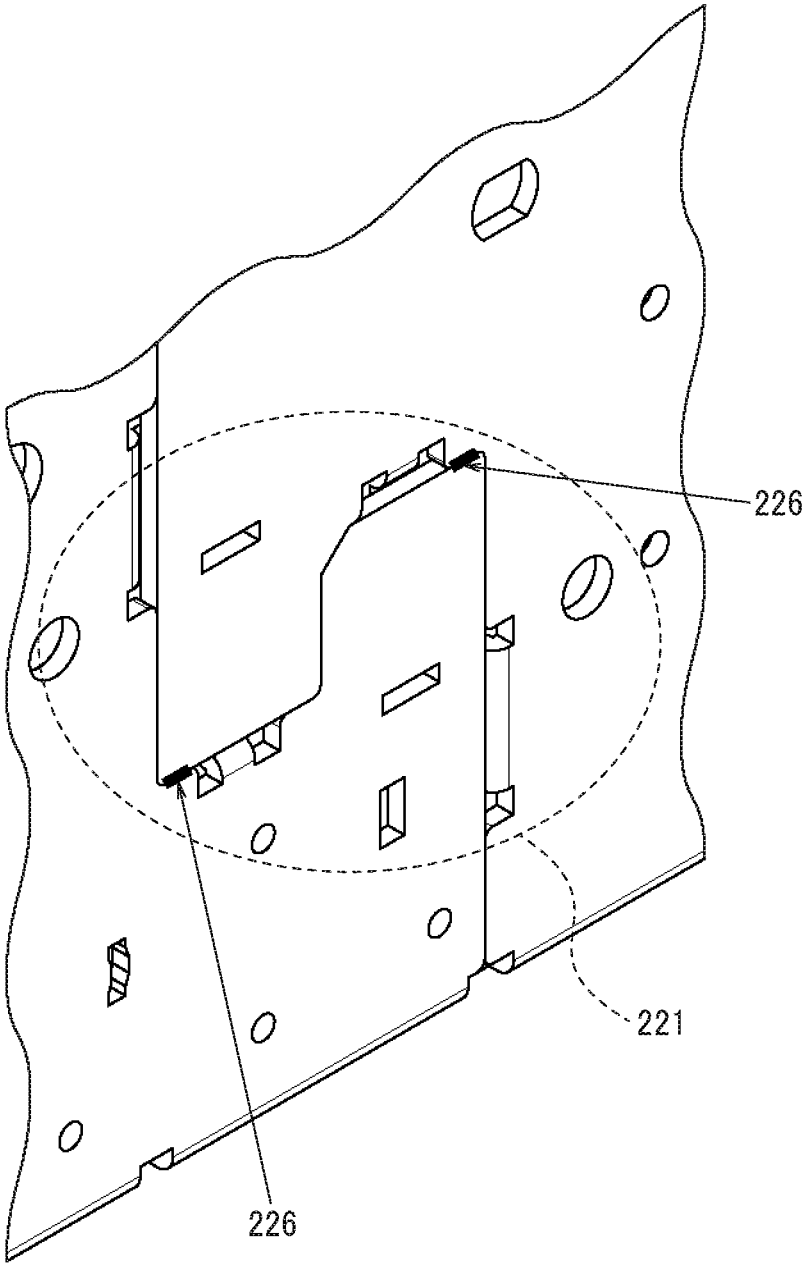
FIG. 23 is an enlarged perspective view of the fastening structure of the fitting part of the stay rod.

FIG. 22 is a partial enlarged perspective view of the second fitting part 221. FIG. 23 is a partially enlarged perspective view of the first fitting part 211. As illustrated in FIG. 22, the second fitting part 221 is fixed by the first laser welding part 226. Further, as illustrated in FIG. 23, the first fitting part 211 is also fixed by the first laser welding part 226. The first laser welding part 226 includes a joint part aligned in the longitudinal direction of adjacent stay-fixing parts 20. The joint part is fixed by laser welding. The first laser welding part 226 is a laser welding portion formed with a constant dimension in the longitudinal direction of the stay rod 1. The first laser welding part 226 is a fastening portion fixed by laser welding on a portion in which the carriage guide part 10 and the stay-fixing part 20 aligned in the longitudinal direction of the stay rod 1 are fitted and joined.

As in the laser-pulse welding part 225 and the first laser welding part 226, the fastening by laser welding is performed to only a fitting part (fitting surface) in the longitudinal direction of the stay rod 1 in a joint-shaped fitting part between the carriage guide part 10 and the stay-fixing part 20. Thus, the stay rod 1 according to the present disclosure can reduce the warpage of stay rod 1. Thus, the present disclosure can provide a long sheet-metal stay with high accuracy.

Figure 24:
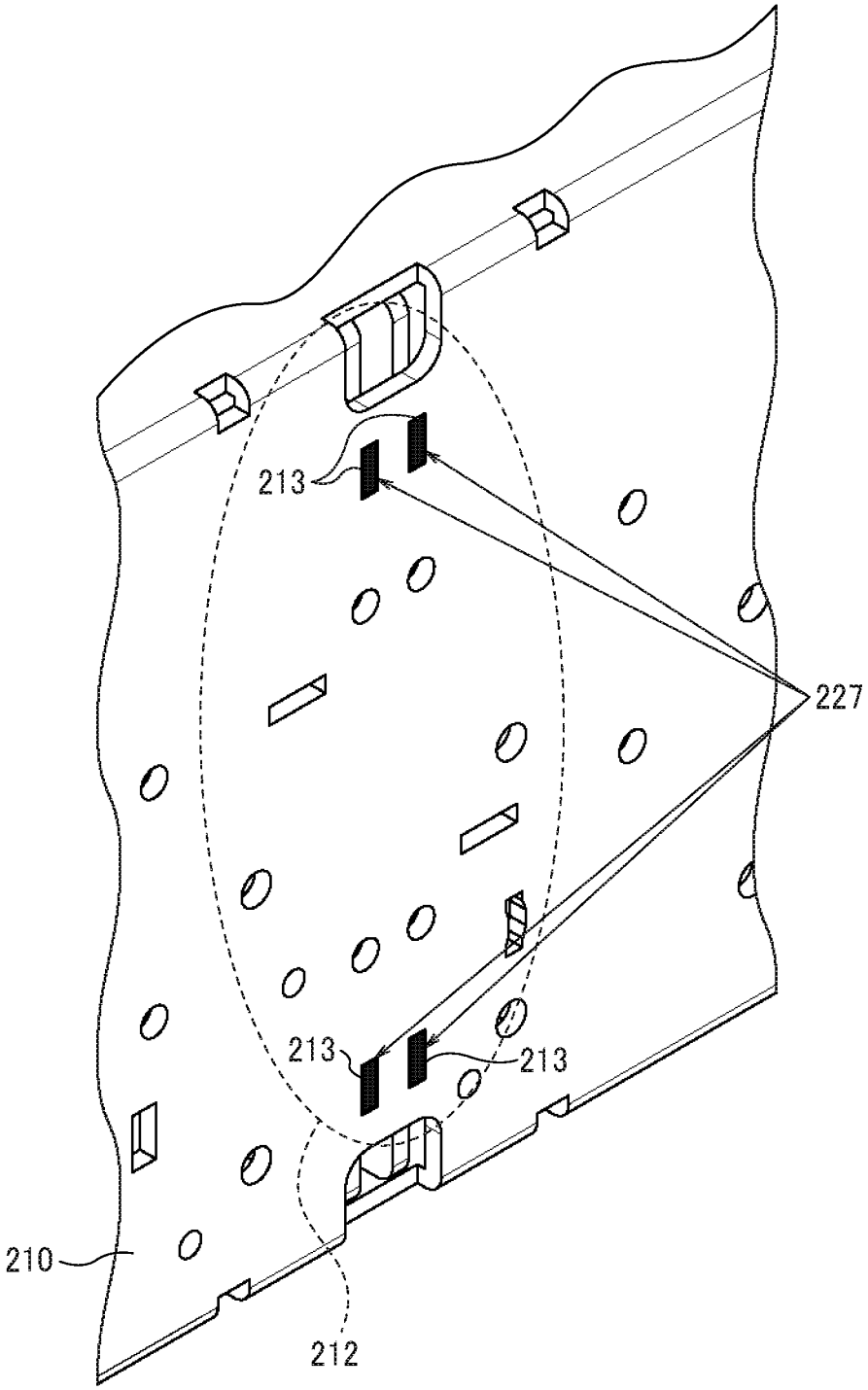
FIG. 24 is an enlarged perspective view of the fastening structure of the fitting part of the stay rod.

FIG. 24 is an enlarged perspective view of a fitting part between the convex part 131 of the carriage guide part 10 and the hole 213 formed in the mounting surface 210 of the stay-fixing part 20. As illustrated in FIG. 24, the convex part 131 and the mounting surface 210 are fixed by a bottom fastening part 212. The bottom fastening part 212 is formed by a second laser welding part 227 in which the convex part 131 and the mounting surface 210 are fixed by laser welding.

As described above, according to the stay rod 1 configured by fastening the carriage guide part 10 and the stay-fixing part 20, only the contact portion aligned with the longitudinal direction of the stay rod 1 is fixed by laser welding. The fastening by laser welding can reduce warpage in the longitudinal direction of the stay rod 1. Thus, the present disclosure can provide a long sheet-metal stay rod 1 with high accuracy. Further, fastening by laser pulse welding is performed on the stay side-surface 220 in which the second fitting part 221 is formed such that a portion of the laser pulse welding extends to the whole length of the stay rod 1 in the longitudinal direction of the stay rod 1. Thus, the influence of thermal distortion can be minimized, and a highly accurate stay rod can be obtained.

Further, forming the carriage guide part 10 and the stay-fixing part 20 with the same material can stabilize the fastening part by laser welding and reduce distortion due to the influence of thermal expansion and the like.

[Another Embodiment of Stay Rod]

Figure 25:
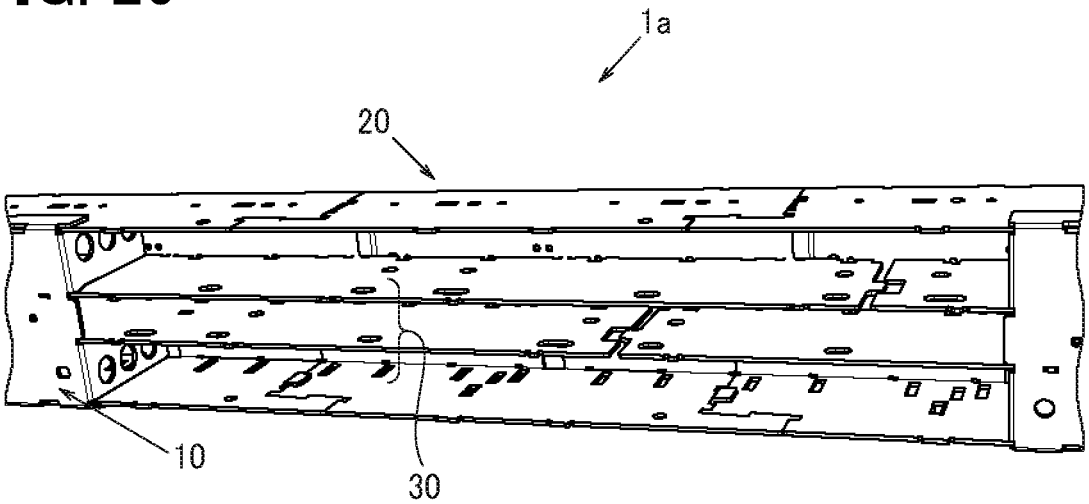
FIG. 25 is a perspective view of a stay rod as another embodiment of a stay rod according to the present disclosure.

Another embodiment of the stay rod according to the present disclosure is described below. As illustrated in FIG. 25, combining and fitting the carriage guide part 10 and the stay-fixing part 20 forms the stay rod 1*a* according to the present disclosure. The stay rod 1*a* includes a reinforcement adjustment plate 30 in an internal space of the structure having a box-shaped cross section. The stay rod 1*a* includes a plurality of reinforcement adjustment plate 30 disposed to match the dimension of the stay rod 1*a* in the longitudinal direction of the stay rod 1*a*. The stays 1*a* are arranged in two rows in the longitudinal direction of the stay rod 1*a*.

Figure 26A:
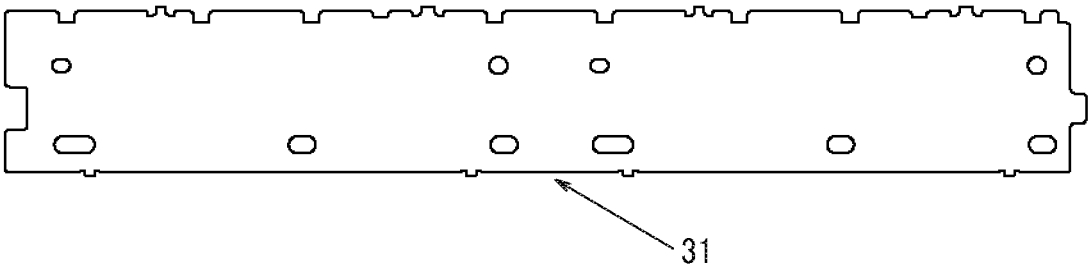
FIGS. 26A and 26B are cross-sectional views of reinforcement adjustment plates of the stay rod.
Figure 26B:
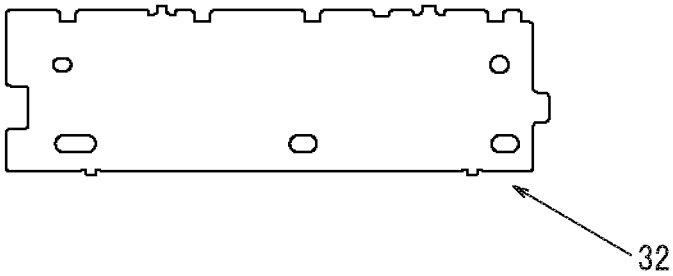

The reinforcement adjustment plate 30 includes a first reinforcement adjustment plate 31 illustrated in FIG. 26A and a second reinforcement adjustment plate 32 illustrated in FIG. 26B. The first reinforcement adjustment plate 31 is longer than the second reinforcement adjustment plate 32 in the longitudinal direction of the stay rod 1*a*.

Figure 27:
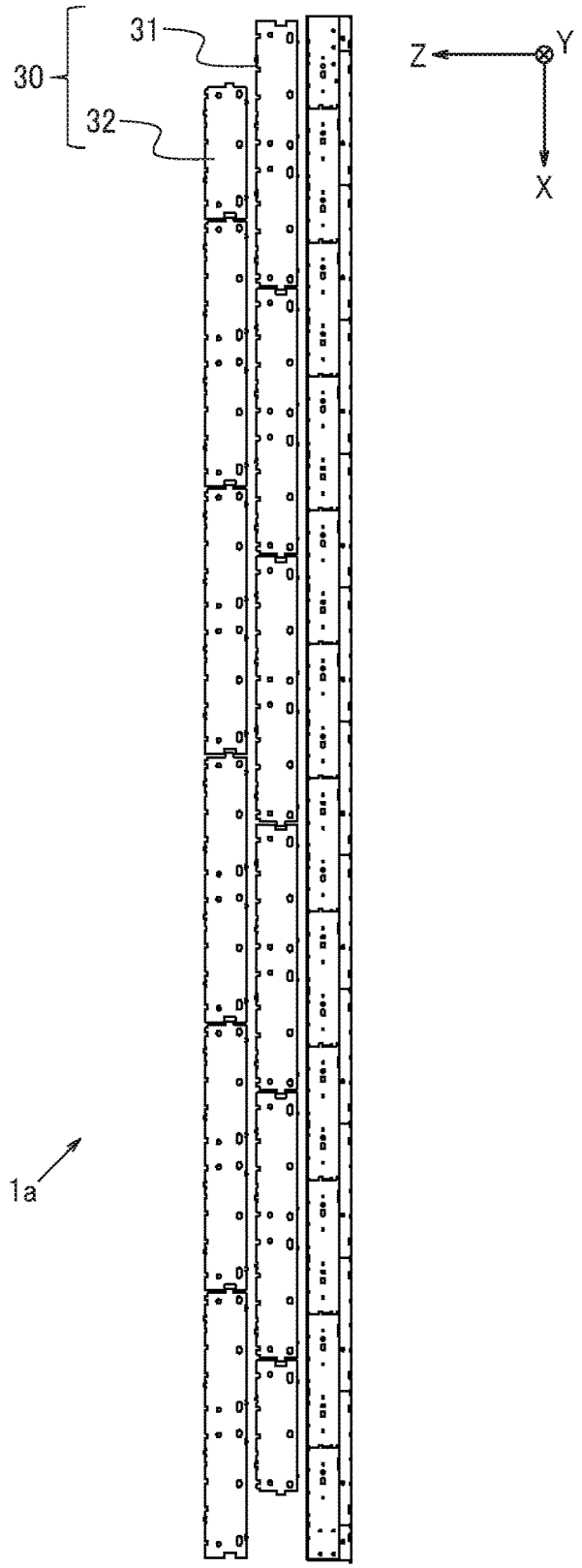
FIG. 27 is a plan view of reinforcement adjustment plates of the stay rod.

Next, an arrangement of the reinforcement adjustment plate 30 is described below. As illustrated in FIG. 27, a plurality of the first reinforcement adjustment plates 31 and a plurality of second reinforcement adjustment plates 32 are respectively fitted and joined in the longitudinal direction of the stay rod 1. If the reinforcement adjustment plate 30 at one longitudinal end of the stay rod 1 is the first reinforcement adjustment plate 31, the second reinforcement adjustment plate 32 is disposed at another longitudinal end of the line following the first reinforcement adjustment plate 31. The first reinforcement adjustment plate 31 has a length that spans the plurality of second fitting parts 221 of the stay rod 1.

The reinforcement adjustment plate 30 is disposed to span a contact portion of the adjacent carriage guide part 10 in the longitudinal direction of the stay rod 1. Thus, the reinforcement adjustment plate 30 enables fine adjustment of the surface flatness of the guide surface 110.

Figure 28A:
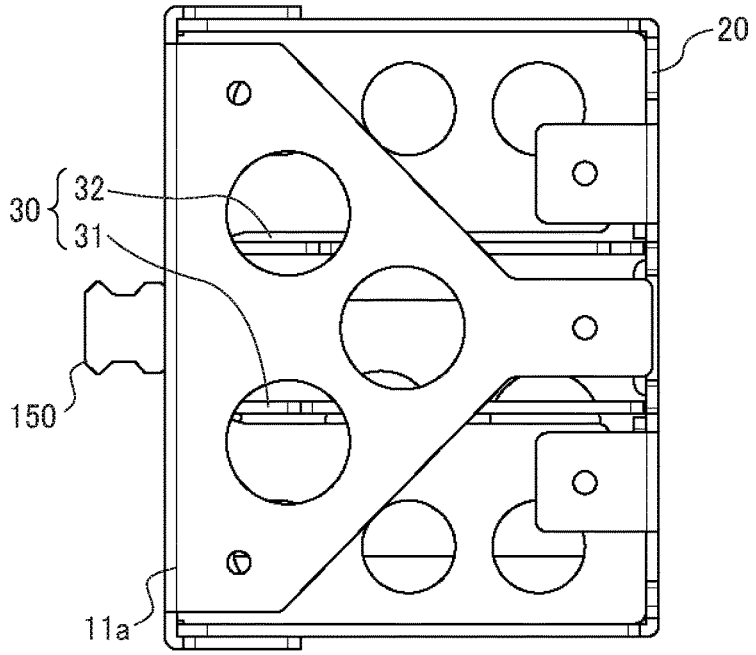
FIGS. 28A and 28B are cross-sectional views of a carriage holding surface in the reinforcement adjustment plate of the stay rod.
Figure 28B:
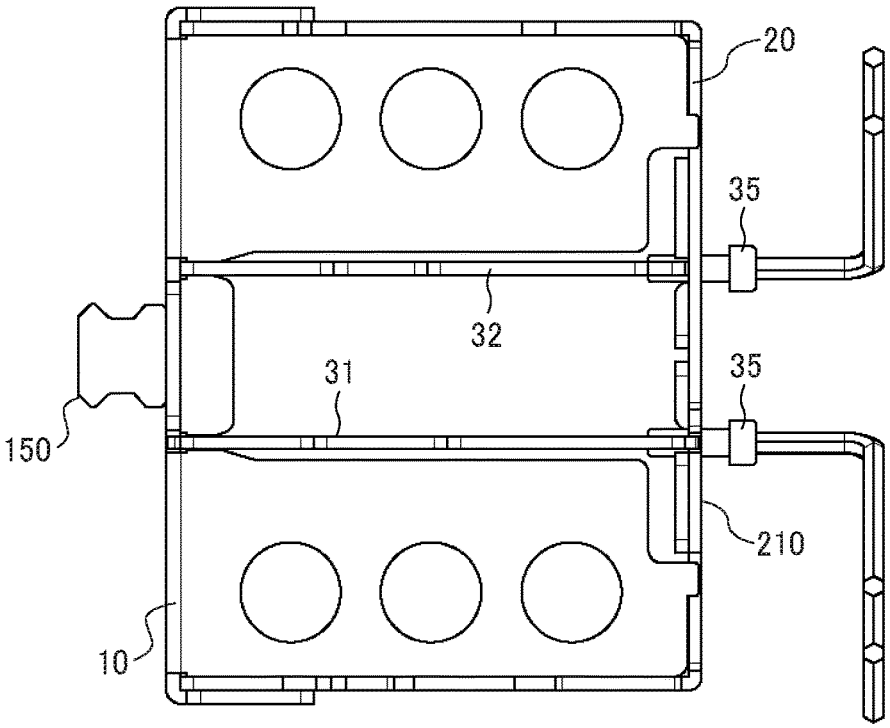

As illustrated in FIG. 28A, the reinforcement adjustment plate 30 is disposed at a position to sandwich the guide rail 150 in the transverse direction (height direction) of the stay rod 1. The guide rail 150 is disposed substantially in a center of the guide surface 110 in the transverse direction (height direction) of the stay rod 1. Thus, as illustrated in FIG. 28B, a position of the reinforcement adjustment plate 30 in a depth direction (lateral direction in FIG. 28B) of the stay-fixing part 20 is adjusted using the adjustment screw 35 from the mounting surface 210 of the stay-fixing part 20. As described above, the reinforcement adjustment plate 30 (the first reinforcement adjustment plate 31 and the second reinforcement adjustment plate 32) positions above and below the guide rail 150. Thus, the reinforcement adjustment plate 30 can further precisely adjust and improve a planar accuracy of the guide surface 110.

[Still Another Embodiment of Stay Rod]

Figure 29:
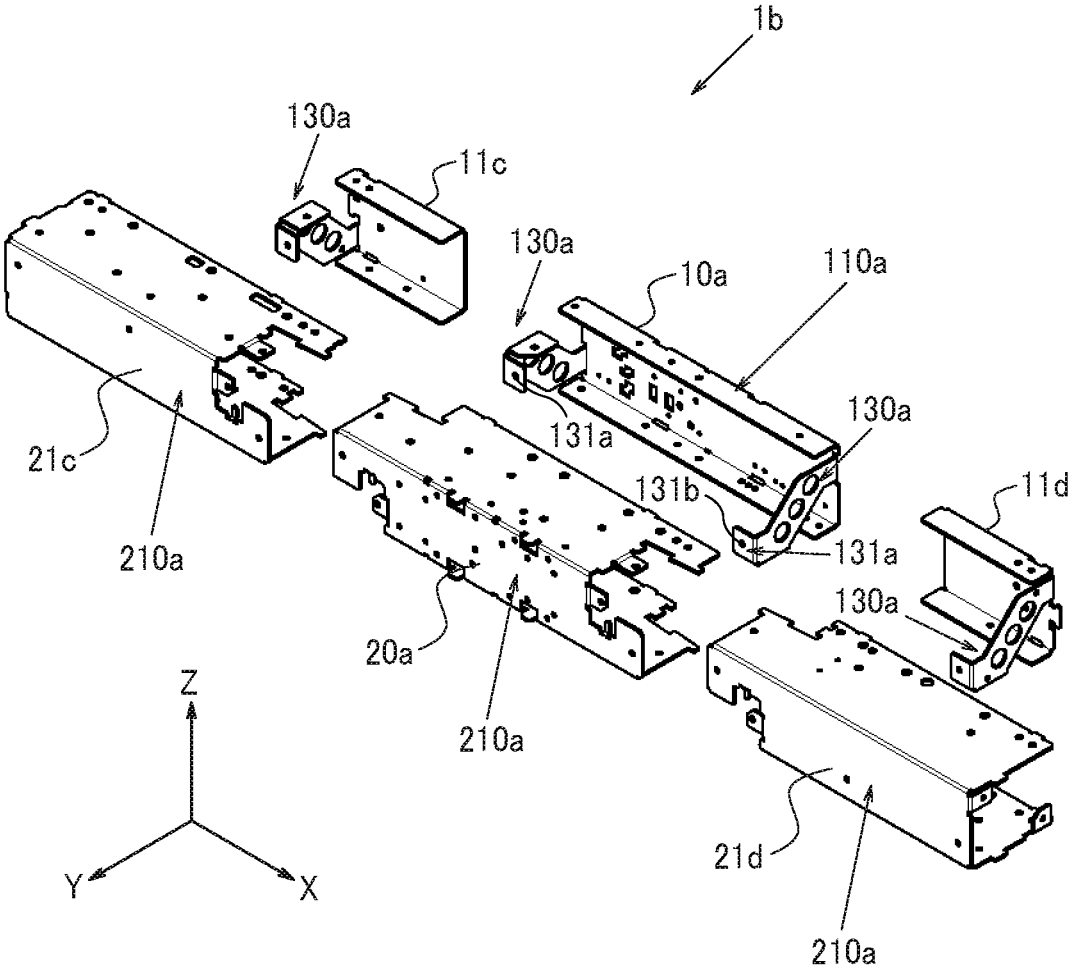
FIG. 29 is a perspective view of a stay rod as a still another embodiment of the stay rod according to the present disclosure.

Next, still another embodiment of the stay rod according to the present disclosure is described below. FIG. 29 is a perspective view of parts constituting a stay rod 1*b* according to the present disclosure. The stay rod 1*b* is mainly composed of a carriage guide part 10*a* as a first part and a stay-fixing part 20*a* as a second part. The carriage guide part 10*a* includes a guide surface 110*a* that constitutes a carriage guide 100*a* to which the guide rail 150 is fixed. The stay-fixing part 20*a* is a surface facing the guide surface 110*a*, and includes a mounting surface 210*a* that constitutes the stay mounting part 200*a*. Further, the stay rod 1*b* includes carriage guide end-parts 11 (11*c* and 11*d*) and stay fixing end-parts 21 (21*c* and 21*d*). Hereinafter, parts different from the parts according to the stay rod 1 as described above are described below in detail.

The carriage guide part 10*a* includes legs 130*a* at both longitudinal ends of the carriage guide part 10*a*. Each leading end of the legs 130*a* includes a leading-end surface part 131*a* that is aligned with the mounting surface 210*a*.

Figure 30A:
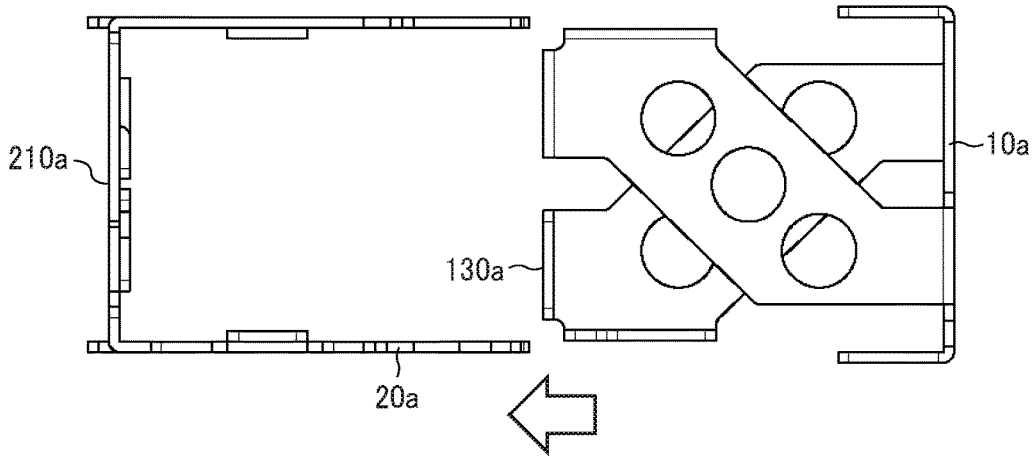
FIGS. 30A to 30C are cross-sectional views of a part of the assembly process of the stay rod.
Figure 30B:
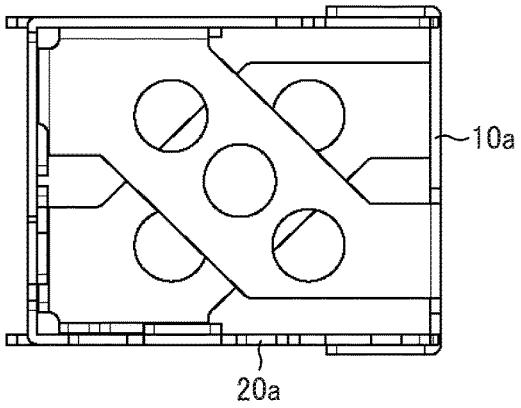
Figure 30C:
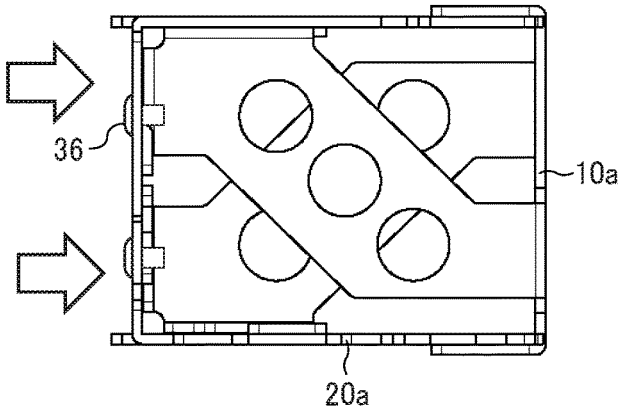
Figure 31A:
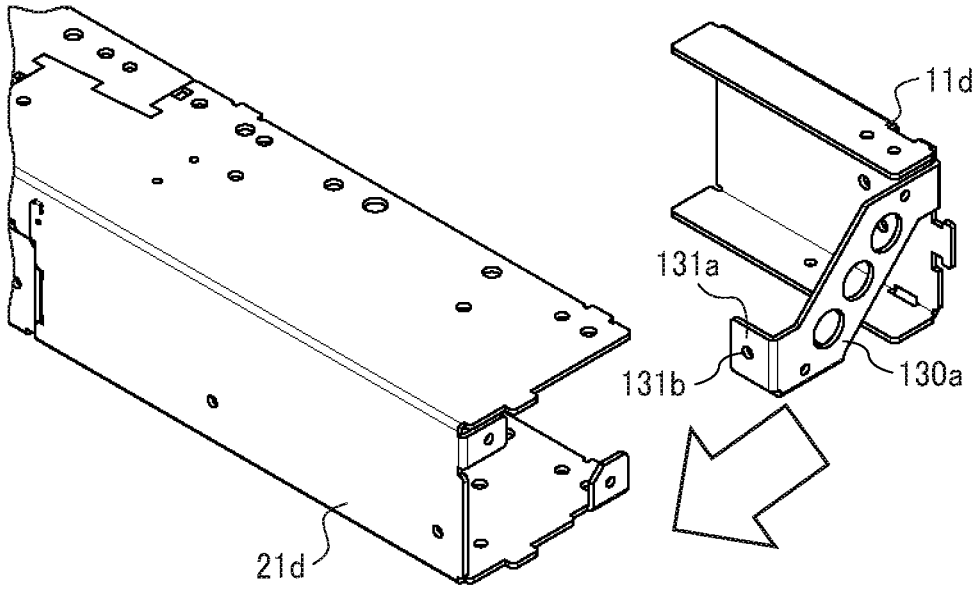
FIGS. 31A and 31B are perspective views of a part of the assembly process of the stay rod.
Figure 31B:
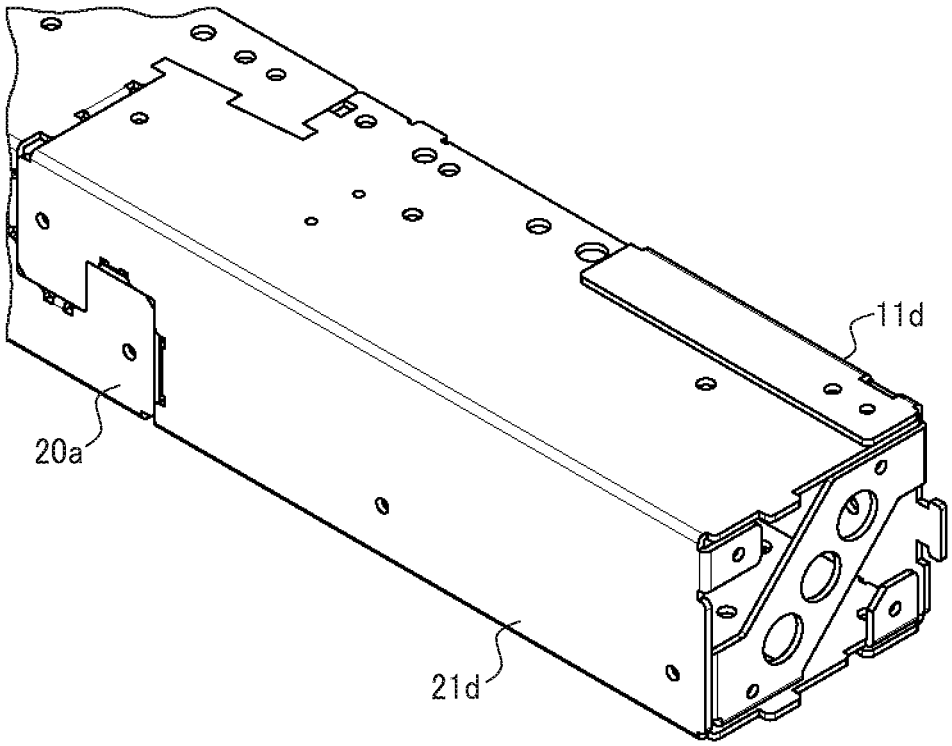
Figure 32A:
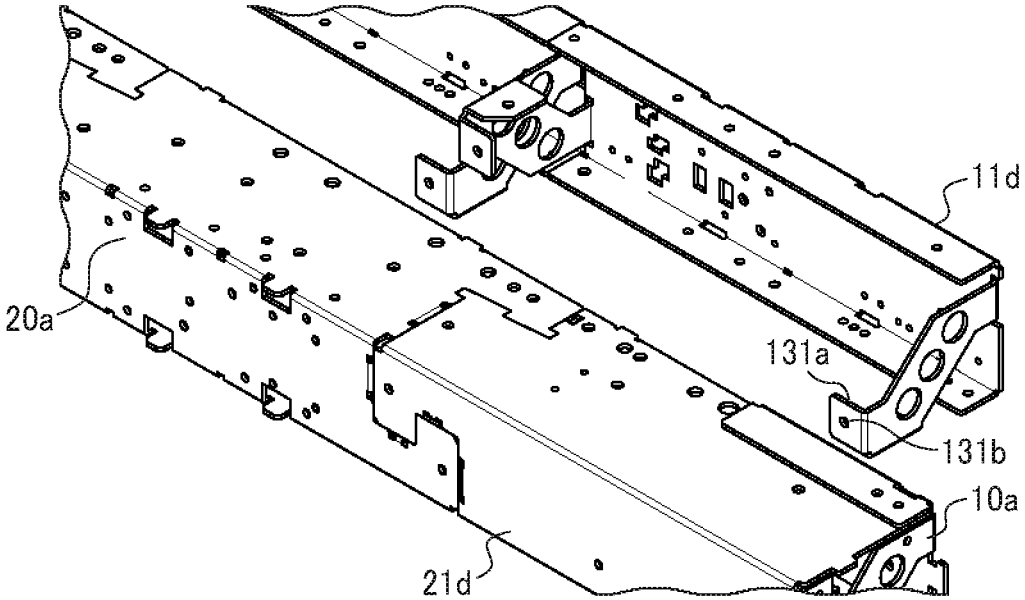
FIGS. 32A and 32B are perspective views of a part of the assembly process of the stay rod.

As illustrated in FIG. 30A, when the carriage guide part 10*a* is inserted into the opening of the stay-fixing part 20*a*, the legs 130*a* contacts (abuts) the inner surface of the mounting surface 210*a* as illustrated in FIG. 30B. In the state as illustrated in FIG. 30B, the rivet 36 is inserted from the mounting surface 210*a* side and fixed with the hole 131*b* formed in the leading-end surface part 131*a* as illustrated in FIG. 30C, More precisely, as illustrated in FIG. 31A, the carriage guide end-part 11*d* is inserted into an opening of members constituted by fitting the stay fixing end-parts 21*d*, the stay-fixing part 20*a*, and the stay fixing end-part 21*c* to close the opening. The covered state is as illustrated in FIG. 31B. Then, as illustrated in FIG. 32A, the carriage guide parts 10*a* are serially arranged and fitted with each other.

Figure 32B:
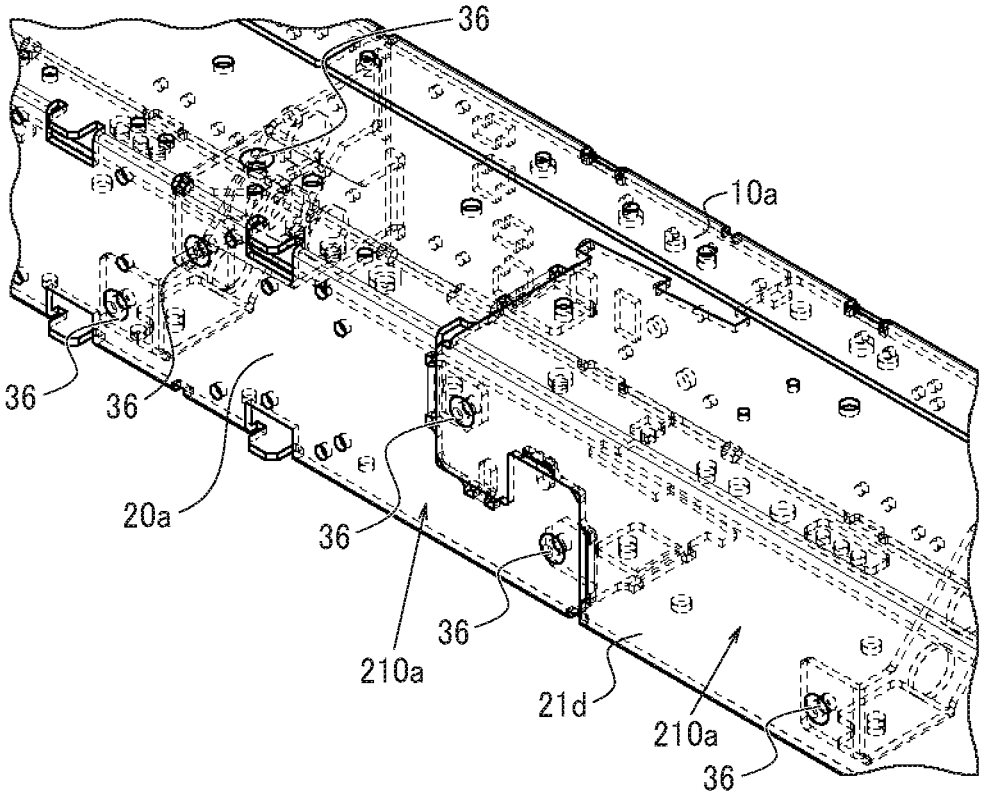

Then, as illustrated in FIG. 32B, the rivet 36 is inserted from the mounting surface 210*a* side, and fixed with the hole 131*b* formed in the leading-end surface part 131*a*. The leading-end surface parts 131*a* at both ends of one carriage guide part 10*a* are respectively fixed to the mounting surfaces 210*a* of different stay-fixing parts 20*a*. Thus, adjusting a degree of fastening by the rivets 36, it is possible to adjust and improve the planar accuracy of the guide surface 110*a*.

[Embodiments of Inkjet Recording Apparatus]

[Holding Structure of Carriage 400]

Figure 33A:
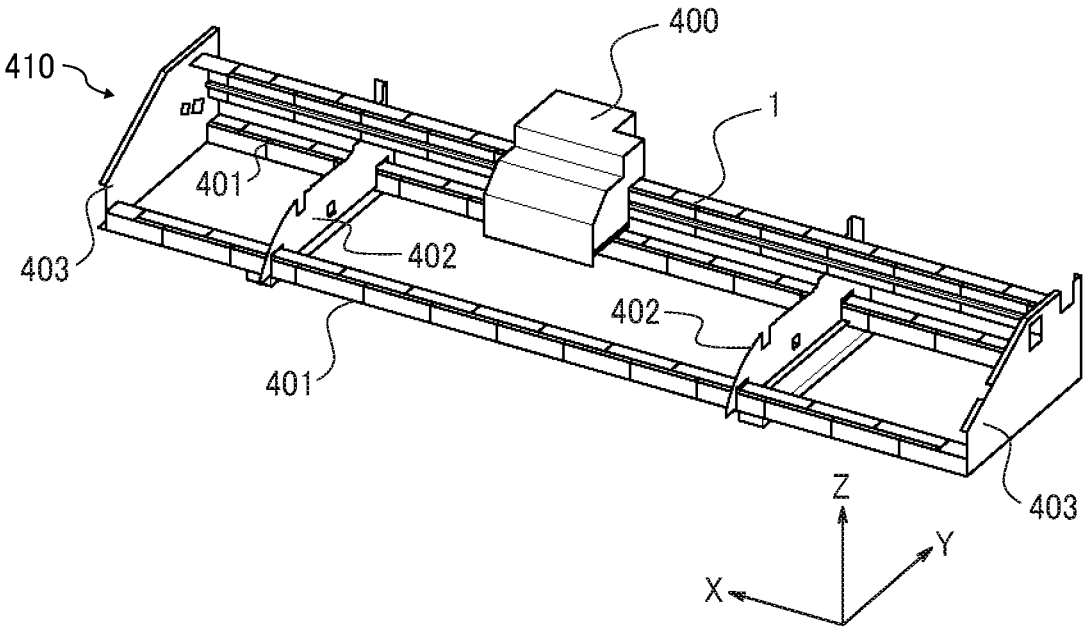
FIGS. 33A and 33B are a perspective view and a cross-sectional view, respectively, of a structural body of an inkjet recording apparatus according to the present disclosure.
Figure 33B:
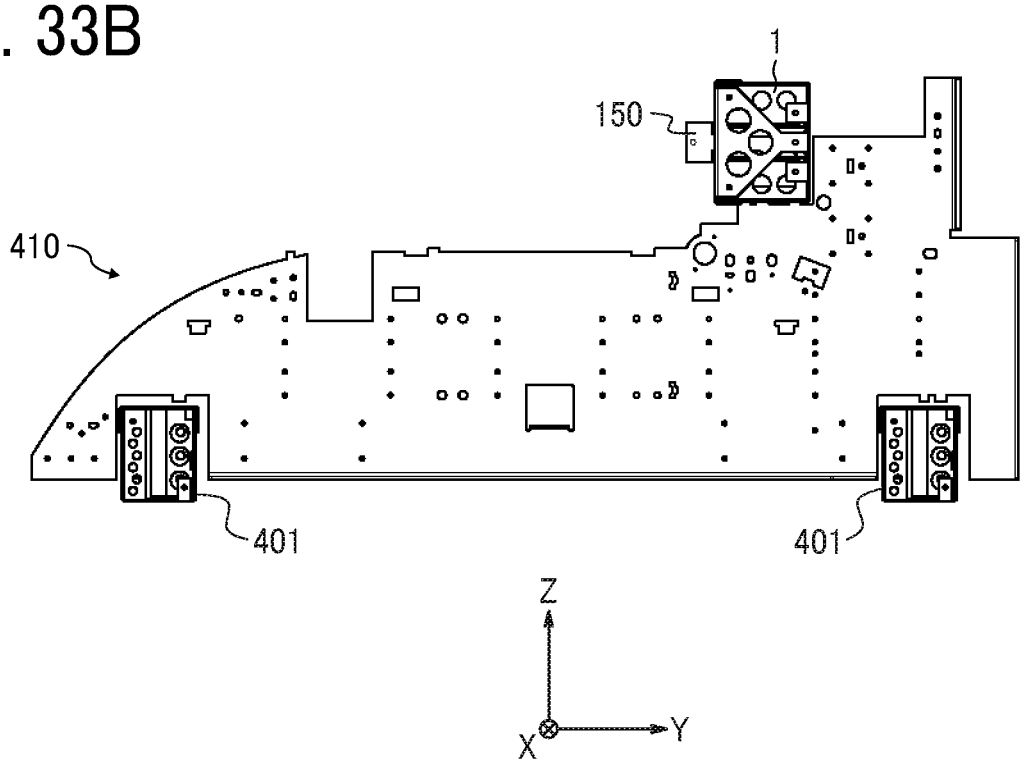

An embodiment of the inkjet recording apparatus 1000 according to the present disclosure is described below. FIGS. 33A and 33B illustrate an embodiment of a holding structure 410 to hold the carriage 400 in the inkjet recording apparatus 1000 according to the present disclosure. Specifically, FIGS. 33 and 33B illustrate an example of the holding structure 410 of the carriage 400 using the stay rod 1 as described above. As illustrated in FIGS. 33A and 33B, the stay rod 1 to which the guide rail 150 (see FIG. 13) is fixed is fixed to the inkjet recording apparatus 1000 through the holding structure 410. The carriage 400 is slidably held by the stay rod 1 fixed to the holding structure 410. The structure includes front-and-rear stays 401, a front-and-rear stay-fixing part 402, and a front-and-rear stay-end fixing part 403. Two of the front-and-rear stays 401 are arranged parallel to each other in the Y-axis direction. The front-and-rear stay-fixing part 402 spans and fixes two of the front-and-rear stays 401. The front-and-rear stay-end fixing part 403 fixes each longitudinal ends of the front-and-rear stays 401.

That is, in the stay rod 1, the stay attachment 200 is fixed to the front-and-rear stay-fixing part 402, and the front-and-rear stay-fixing part 402 is fixed to a housing of the inkjet recording apparatus 1000 by the front-and-rear stay-end fixing part 403. The carriage 400 is slidably fixed to the stay rod 1 by the above-described structure. Thus, the carriage 400 can accurately slide the liquid discharge head 414 in a main scanning direction as indicated by the designation "MSD" in FIG. 34. The liquid discharge head 414 discharges an imaging material such as liquid ink to the recording medium.

An entire schematic configuration of an inkjet recording apparatus 1000 is described below. An inkjet recording apparatus 1000 is an example of an apparatus to discharge a fluid such as a liquid. The term "liquid discharge apparatus" used herein is an apparatus including a liquid discharge head or a liquid discharge device to discharge liquid by driving the liquid discharge head. The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic part, such as electronic substrate and piezoelectric element, and media, such as powder layer, organ model, and testing cell. The "material on which liquid can be adhered" includes any material on which liquid is adhered, unless particularly limited.

Examples of the "material on which liquid can be adhered" include any materials on which liquid can be adhered even temporarily, such as paper, thread, fiber, fabric, leather, metal, plastic, glass, wood, and ceramic.

Further, the term "liquid" includes any liquid having a viscosity or a surface tension that can be discharged from the liquid discharge head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The "liquid discharge apparatus" may be an apparatus to relatively move the liquid discharge head and a material on which liquid can be adhered. However, the liquid discharge apparatus is not limited to such an apparatus. For example, the liquid discharge apparatus may be a serial head apparatus that moves the head, a line head apparatus that does not move the head, or the like.

Examples of the "liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The term "liquid discharge head" used herein is a functional component to discharge or jet liquid from nozzles. Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the liquid discharge head and a functional part(s) or mechanism combined to the liquid discharge head to form a single unit. Examples of the "single unit" include a combination in which liquid discharge head and one or more functional parts and units are secured to each other through, e.g., fastening, bonding, or engaging, and a combination in which one of the heads and the functional parts and devices is movably held by another. The head may be detachably attached to the functional part(s) or unit(s) s each other.

For example, liquid discharge head and the head tank may form the liquid discharge device as a single unit. Alternatively, the head and the head tank coupled (connected) with a tube or the like may form the liquid discharge device as a single unit. Here, a unit including a filter may further be added to a part between the head tank and the liquid discharge head.

In still another example, the liquid discharge device includes the liquid discharge head movably held by a guide that forms part of a main scan moving unit, so that the liquid discharge head and the main scan moving unit form a single unit. The liquid discharge device may include the liquid discharge head, the carriage, and the main scan moving unit that form a single unit.

Further, as a liquid discharge unit, a cap member which is a part of the maintenance unit is fixed to the carriage 400 attached with the liquid discharge head, and the liquid discharge head and the carriage 400 and the maintenance unit form a single unit.

Further, in still another example, the liquid discharge device includes tubes connected to the head tank or the liquid discharge head mounting a channel part so that the liquid discharge head and a supply unit form a single unit. Through this tube, the liquid in the liquid storage source such as an ink cartridge is supplied to the liquid discharge head.

The main scan moving unit may be a guide only. The supply unit may be a tube(s) only or a loading unit only.

For example, the "liquid discharge device" includes a combination of the liquid discharge head with at least one of a head tank, a supply unit, a maintenance unit, and a main scan moving unit. The liquid discharge unit also includes the carriage 400 according to the present disclosure as described above.

Figure 34:
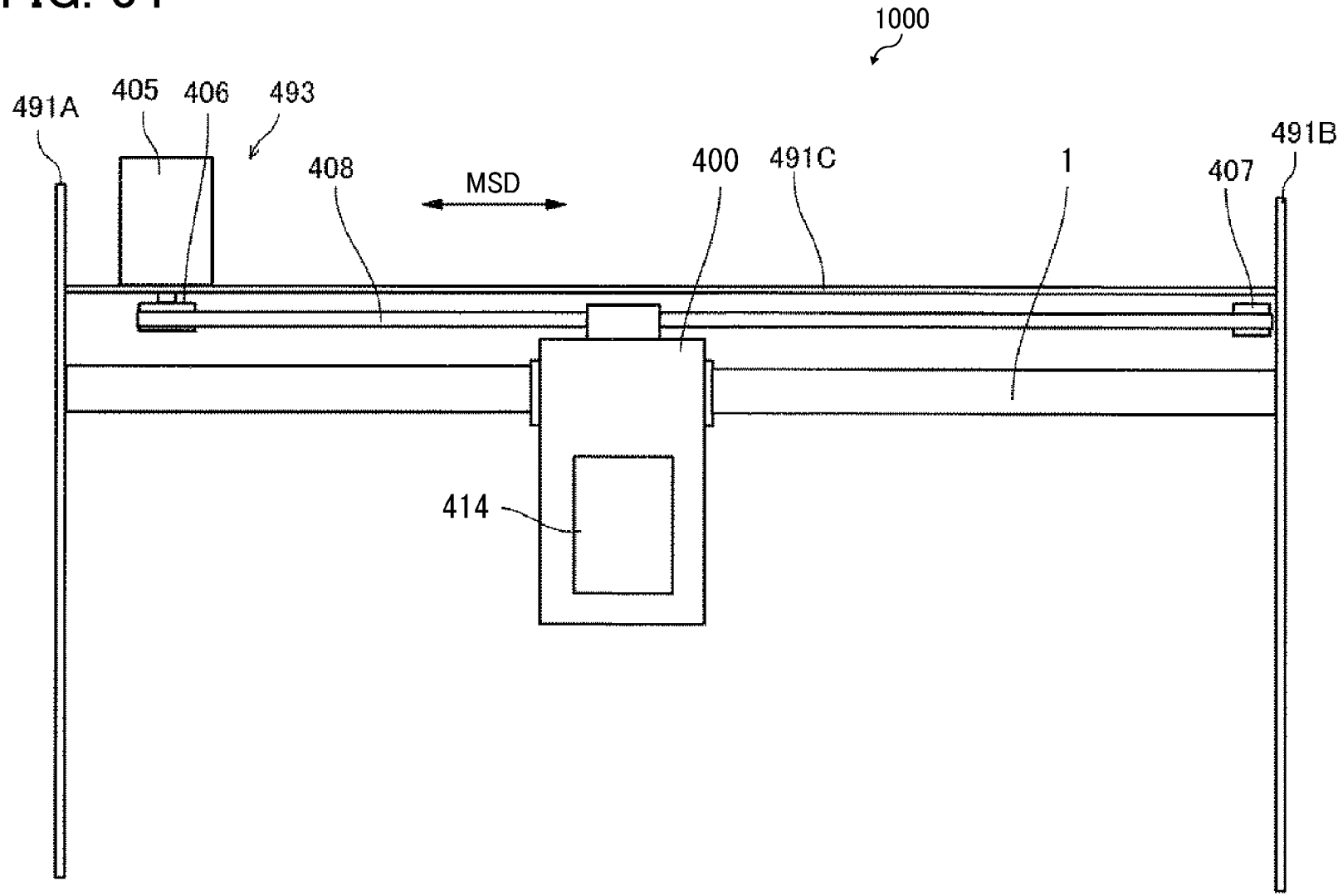
FIG. 34 is a plan view of a liquid discharge device of an inkjet recording apparatus according to embodiments of the present disclosure.

Here, as a drive mechanism of the liquid discharge device with reference to the carriage 400 is described below. FIG. 34 is a plan view of the carriage 400 held by the stay rod 1. In FIG. 34, the carriage 400 mounts a liquid discharge device in which the liquid discharge head 414 according to the present disclosure and a head tank 450 (see FIG. 35) are formed into a single unit. The liquid discharge head 414 of the liquid discharge device discharges, for example, liquid of each color of yellow (Y), cyan (C), magenta (M), and black (K).

The liquid discharge head 414 includes nozzle array including a plurality of nozzles arrayed in row in a sub-scanning direction perpendicular to the main scanning direction. The liquid discharge head 414 is mounted to the carriage 400 so that ink droplets are discharged downward. The main scanning direction indicated by arrow MSD is a direction perpendicular to a conveyance direction of the recording medium.

The inkjet recording apparatus 1000 according to the present disclosure is a serial-type apparatus in which a main scan moving unit 493 reciprocally moves a carriage 400 in a main scanning direction MSD in FIG. 34. The main scan moving unit 493 includes the stay rod 1, a main scanning motor 405, and a timing belt 408, for example.

The stay rod 1 and a rear-side plate 491C connect a left-side plate 491A and a right-side plate 491B that movably holds the carriage 400. The main scanning motor 405 reciprocally moves the carriage 400 in the main scanning direction MSD via the timing belt 408 entrained around a driving pulley 406 and a driven pulley 407.

In still another example, the main scan moving unit 493 includes the liquid discharge head 414 movably held by the stay rod 1 as a guide that forms part of a main scan moving unit 493, so that the liquid discharge head 414 and the main scan moving unit 493 form a single unit. The liquid discharge device may include the liquid discharge head 414, the carriage 400, and the main scan moving unit 493 that form a single unit.

In another example, the cap that forms part of the maintenance unit is secured to the carriage 400 mounting the liquid discharge head 414 so that the liquid discharge head 414, the carriage 400, and the maintenance unit form a single unit to form the liquid discharge device.

Further, in still another example, the liquid discharge device includes tubes connected to the head tank 450 or the liquid discharge head 414 mounting a channel part so that the liquid discharge head 414 and a supply unit form a single unit. The liquid of the liquid storage source is supplied to the liquid discharge head 414 via the tube.

The main scan moving unit 493 may be a guide (stay rod 1) only. The supply unit may be a tube(s) only or a loading unit only.

Next, an embodiment of the of the liquid discharge heads 414 is described with reference to FIG. 35. The liquid discharge head 414 is configured to include a cover 442, a connector 443, a channel part 444, and a tube 456. The cover 442, the connector 443, and the channel part 444 form the head tank 450.

Figure 35:
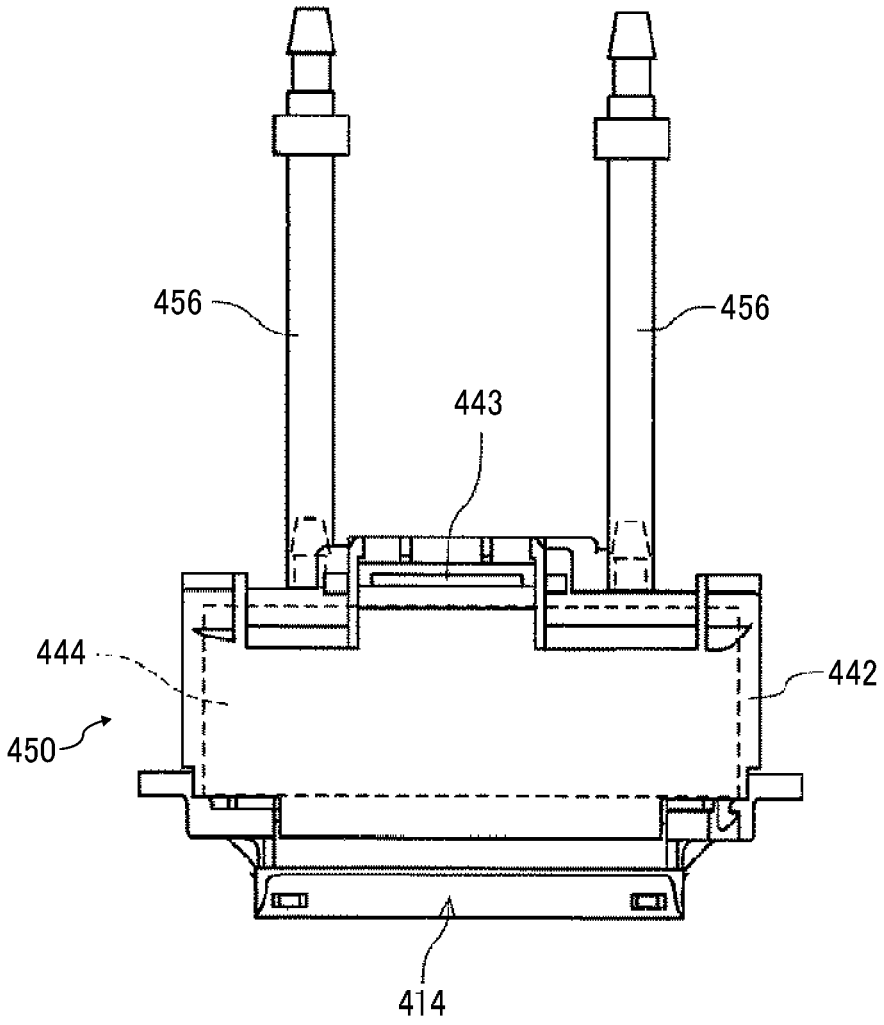
FIG. 35 is a cross-sectional view of a liquid discharge device of an inkjet recording apparatus according to embodiments of the present disclosure.

The liquid discharge head 414 illustrated in FIG. 35 is connected to a tube 456, and the liquid discharge head 414, a channel part 444 that forms a part of the head tank 450 of the supply unit, and the tube 456 form a single unit. The liquid of the liquid storage source is supplied to the liquid discharge head 414 through the tube 456 and the head tank 450.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. An apparatus, comprising:

a carriage; and a stay rod comprising:

a guide to slidably hold the carriage, the guide to be fixed to an apparatus body;

a plurality of first parts each including a guide surface to form the guide; and a plurality of second parts each including a mounting surface to be mounted to the apparatus body, wherein the plurality of first parts and the plurality of second parts are combined to have an elongated box-shaped cross section in which the guide surface of the plurality of first parts faces the mounting surface of the plurality of second parts, the plurality of first parts is arranged side by side in a longitudinal direction of the stay rod and is joined to the plurality of second parts at each joint formed at each end of the plurality of first parts, the plurality of second parts is fitted together in the longitudinal direction of the stay rod at each of a fitting part formed at each end of the plurality of second parts, and a position of each joint at each end of the plurality of first parts differs from a position of the fitting part at each end of the plurality of second parts.

2. The apparatus according to claim 1, wherein each of the plurality of first parts and the plurality of second parts has a C-channel cross-sectional shape, and a depth of a flange of each of the plurality of second parts is larger than a depth of a flange of each of the plurality of first parts.

3. The apparatus according to claim 1, wherein the fitting part formed at each end of the plurality of second parts includes a key-shaped part including at least one convex part and at least one concave part.

4. The apparatus according to claim 3, wherein the fitting part of the plurality of second parts includes:

a first fitting part formed at each end of the mounting surface in the longitudinal direction of the stay rod; and a second fitting part including the key-shaped part formed at each end of a side surface rising from the mounting surface in the longitudinal direction of the stay rod.

5. The apparatus according to claim 1, wherein each of the plurality of first parts includes a guide-bending inner part that is an inner side of a bent part rising from the mounting surface of the plurality of first parts, each of the plurality of second parts includes a stay bending tip formed on a tip of a side surface of the plurality of second parts, and the stay bending tip of the plurality of second parts contacts the guide-bending inner part of the plurality of first parts.

6. The apparatus according to claim 5, wherein the stay bending tip of the plurality of second parts is fixed to the guide-bending inner part of the plurality of first parts.

7. The apparatus according to claim 6, wherein the guide-bending inner part of the plurality of first parts includes a plurality of holes along a longitudinal direction of the plurality of first parts, the stay bending tip of the plurality of second parts includes a plurality of convex parts along a longitudinal direction of the plurality of second parts, and the plurality of convex parts is inserted into the plurality of holes while the stay bending tip of the plurality of second parts contacts the guide-bending inner part of the plurality of first parts.

8. The apparatus according to claim 6, wherein the plurality of first parts includes a guide-bending tip that is a tip of the bent part, and the side surface of the plurality of second parts is fixed to the guide-bending tip of the plurality of first parts by laser pulse welding in the longitudinal direction of the stay rod.

9. The apparatus according to claim 1, wherein the fitting part of the plurality of second parts is fixed on a contact portion formed along the longitudinal direction of the stay rod at which the plurality of second parts contacts.

10. The apparatus according to claim 9, wherein the fitting part of each of the plurality of second parts is fixed by laser welding.

11. The apparatus according to claim 1, wherein the plurality of first parts and the plurality of second parts are made from identical sheet metal material, and a rigidity of the plurality of first parts is lower than a rigidity of the plurality of second parts.

12. The apparatus according to claim 11, wherein a thickness of the plurality of first parts is equal to or less than a thickness of the plurality of second parts.

13. An inkjet recording apparatus, comprising:

a liquid discharge head to discharge a liquid to a medium conveyed in a conveyance direction;

a carriage to mount the liquid discharge head and movable in a main scanning direction perpendicular to the conveyance direction; and the stay rod according to claim 1, arranged in the main scanning direction to movably hold the carriage.

* * * * *